US008505682B2

(12) United States Patent
Jones et al.

(10) Patent No.: US 8,505,682 B2
(45) Date of Patent: Aug. 13, 2013

(54) LIGHTWEIGHT POLYMERIC EXHAUST COMPONENTS

(75) Inventors: Daniel P. Jones, Royal Oak, MI (US); Philippe Leboeuf, St Maurice (FR); Karl Paul Maurer, North Branch, MN (US)

(73) Assignee: E I du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 13/454,285

(22) Filed: Apr. 24, 2012

(65) Prior Publication Data

US 2012/0273300 A1 Nov. 1, 2012

Related U.S. Application Data

(60) Provisional application No. 61/480,794, filed on Apr. 29, 2011.

(51) Int. Cl.
*F01N 13/16* (2010.01)

(52) U.S. Cl.
USPC ..... 181/246; 181/258; 181/270

(58) Field of Classification Search
USPC ..... 181/264, 258, 270, 246, 244
See application file for complete search history.

(56) References Cited

U.S. PATENT DOCUMENTS

| | | | | |
|---|---|---|---|---|
| 4,408,679 | A * | 10/1983 | Littrell | 181/243 |
| 4,880,078 | A | 11/1989 | Inoue et al. | |
| 4,993,513 | A * | 2/1991 | Inoue et al. | 181/282 |
| 5,052,513 | A | 10/1991 | Yoshikawa et al. | |
| 5,321,214 | A | 6/1994 | Uegane | |
| 5,340,952 | A * | 8/1994 | Takiguchi | 181/282 |
| 5,468,923 | A * | 11/1995 | Kleyn | 181/282 |
| 5,468,928 | A | 11/1995 | Kleyn | |
| 5,477,014 | A * | 12/1995 | Dunne et al. | 181/244 |
| 6,543,577 | B1 * | 4/2003 | Ferreira et al. | 181/282 |
| 7,229,937 | B2 | 6/2007 | Bascom et al. | |
| 7,434,656 | B2 * | 10/2008 | Yasuda et al. | 181/227 |
| 7,694,778 | B2 * | 4/2010 | Toyoshima et al. | 181/268 |
| 7,744,693 | B2 | 6/2010 | Mabey | |

(Continued)

FOREIGN PATENT DOCUMENTS

| | | |
|---|---|---|
| EP | 0396753 | 8/1990 |
| EP | 0394451 | 10/1990 |
| EP | 0466064 | 7/1994 |

OTHER PUBLICATIONS

Japan Abstract JP61034310.

(Continued)

*Primary Examiner* — Forrest M Phillips

(57) ABSTRACT

Disclosed is a muffler assembly including: a) polymeric housing having an interior surface and at least one opening for at least one inlet and one outlet exhaust pipe; b) at least one metal inlet exhaust pipe and at least one metal outlet exhaust pipe positioned within the openings to provide housing-exhaust pipe interfaces; c) a thermal insulating material coating the interior surface of the polymeric housing and extending through the housing-exhaust pipe interfaces; wherein the thermal insulating material seals the muffler assembly at the housing-exhaust pipe interfaces; and wherein the muffler assembly has a leak rate of 105 Liters/minute or less at 4.5 psig pressure. An optional muffler assembly has body mounting adapters attached to the inlet and outlet exhaust pipes and positioned within the openings to provide housing-body mounting adapter interfaces. Also disclosed are processes for manufacturing the muffler assemblies.

19 Claims, 12 Drawing Sheets

(56) References Cited

U.S. PATENT DOCUMENTS

| | | | | |
|---|---|---|---|---|
| 7,810,609 | B2 * | 10/2010 | Sikes et al. | 181/250 |
| 7,942,237 | B2 * | 5/2011 | van de Flier et al. | 181/256 |
| 2004/0188027 | A1 | 9/2004 | Larocco | |
| 2005/0023076 | A1 | 2/2005 | Huff et al. | |
| 2007/0240932 | A1 | 10/2007 | Van de Flier et al. | |
| 2009/0078499 | A1 | 3/2009 | Sikes | |
| 2009/0194364 | A1 | 8/2009 | Leboeuf | |
| 2010/0029819 | A1 | 2/2010 | Palmer et al. | |
| 2010/0269344 | A1 | 10/2010 | Leboeuf | |
| 2010/0307865 | A1 | 12/2010 | Olsen | |

OTHER PUBLICATIONS

Japan Abstract JP610077544.
Japan Abstract JP59155528.
International Search Report PCT/US2012/035809.

* cited by examiner

LIGHTWEIGHT POLYMERIC EXHAUST COMPONENTS

CROSS REFERENCE TO RELATED APPLICATION

This application claims priority to Application No. 61/480,794, filed Apr. 29, 2011.

FIELD OF THE INVENTION

The invention relates to a lightweight polymeric muffler assembly designed so that the acoustic properties of the muffler assembly can be easily altered.

BACKGROUND OF THE INVENTION

Exhaust system components of internal combustion and other types of engines are principally designed to reduce the noise exiting the engine with the exhaust gases. Typical types of uses for these systems are on automobiles, trucks, snowmobiles, motorcycles, boats, motorized scooters, railroad engines, electrical generators, golf carts, tractors, lawn mowers, and other motorized agricultural, industrial, and landscaping equipment. Virtually any internal combustion engine includes a muffler (system) as a component. Because of the high temperatures of the exhaust gases, and the corrosive nature of those gases, metals, particularly steel, have traditionally been used for mufflers. Corrosion is a problem with these metals, but that has partially been solved by using more expensive alloys such as stainless steel or steel alloys such as aluminized steel. Nevertheless mufflers have tended to be bulky (needed to reduce the noise sufficiently), and heavy because of the high density of metals.

More recently it has been proposed to use mufflers in which the muffler body is a polymer with good high temperature resistance, see for instance U.S. Pat. Nos. 5,321,214; 5,340,952; 5,052,513; 6,543,577; and European Patent 446,064A2.

Today, with emissions regulations tightening every year, especially when related to carbon dioxide ($CO_2$) emissions, and increasing demands for improved fuel economy, weight reduction has become a necessity for all applications related to internal combustion engines, especially for automobiles, commercial trucks, and other vehicles. In addition to emissions requirements, the ability to package exhaust system components to be as compact as possible is attractive, especially for non-automotive applications, such as small engines for lawn and garden, power tools, generators and generator sets.

Due to the extremely high temperatures involved with the exhaust gases produced during the combustion process, previous attempts to reduce weight in exhaust system components by using polymeric materials relied heavily upon thermoset polymers, thermoset composite materials, and thinner gauge steel or steel alloys. Exhaust system components made using thermoplastic polymers require considerable insulation to protect them from the hot gases and the hot exhaust pipes used to channel those gases. Previous embodiments of polymeric mufflers, for example, have used copious amounts of glass fiber matting, glass fiber fabrics, or glass fiber roving to provide thermal as well as acoustic insulation, infusible polymer or high melting temperature polymers bushings, or other insulating materials, such as ceramic, cleverly designed metal adaptors, metallic wire mesh, and even thermoset rubbers.

U.S. Pat. No. 7,810,609 teaches an absorption muffler comprising a metallic exhaust pipe including a plurality of perforations, a polymeric housing carried by the exhaust pipe and enclosing the plurality of perforations, and including axially opposed ends. The acoustic insulation is carried between the thermal insulation and the polymeric housing. The muffler comprises flanges to seal the muffler assembly at the interface of the polymeric housing and the exhaust pipe.

U.S. Pat. No. 5,468,923 discloses a polymeric muffler including two halves, each with baffle walls and gas flow openings integrally molded therein. The gas flow openings do not intersect with the mating edges of the baffle walls. The muffler halves are joined along the mating edges of the baffle walls and the outer walls of the two muffler halves.

JP61077544 teaches a silencer material with silencing properties by attaching a viscous elastic body made of synthetic resin to the back of a plate-like non-woven cloth formed of synthetic resin fibers.

JP61034310 discloses a foamed and shaped body to be used as a silencing member by forming a skin layer. The skin layer has higher heat resisting characteristics than that of the foamed part.

US20070240932 teaches composite muffler systems formed of a long fiber thermoplastic. One suitable muffler structure is a multi-piece muffler assembly including at least one long fiber thermoplastic shell section.

EP394451B1 teaches a light-weight muffler having a high noise deadening effect. The outer shell may be a single layer of a thermotropic liquid crystal polyester or of a multiple layer structure comprising a first layer of a thermotropic liquid crystal polyester and a second layer of another structural material such as stainless steel.

US20100269344 discloses a process for making muffler systems wherein the muffler polymeric bodies have a cross section that is constant over the length of the muffler polymeric body.

US20090194364 discloses mufflers having polymeric bodies that are protected from being overheated from the exhaust pipe by having an air gap between the exhaust pipe and the polymeric body.

However, there is still a need for polymeric exhaust mufflers having improved acoustic tuning capabilities than can be achieved using previous designs. What is needed is a muffler that utilizes a reflective tuning technique, similar to what is done in most metal mufflers on the market today.

SUMMARY OF THE INVENTION

Disclosed is a muffler assembly comprising:

a) a polymeric housing having an interior surface and at least one opening for at least one inlet and one outlet exhaust pipe;

b) at least one metal inlet exhaust pipe and at least one metal outlet exhaust pipe positioned within said openings to provide housing-exhaust pipe interfaces;

c) a thermal insulating material coating said interior surface of the polymeric housing and extending through the housing-exhaust pipe interfaces;

wherein said thermal insulating material seals the muffler assembly at the housing-exhaust pipe interfaces; and wherein the muffler assembly has a leak rate of 105 Liters/minute or less at 4.5 psig pressure.

Another embodiment is a muffler assembly comprising:

a) a polymeric housing having an interior surface and at least one opening for at least one inlet and one outlet exhaust pipe;

b) at least one metal inlet exhaust pipe and at least one metal outlet exhaust pipe having body mounting adapters attached to the inlet and outlet exhaust pipes and positioned within said openings within said openings to provide housing-body mounting adapter interfaces;

c) a thermal insulating material coating the interior surface of the polymeric housing and extending through the housing-body mounting interfaces;

wherein said thermal insulating material seals the muffler assembly at the housing-body mounting adapter interfaces; and wherein the muffler assembly has a leak rate of 105 Liters/minute or less at 4.5 psig pressure.

Also disclosed are various processes for making a polymeric muffler assembly.

BRIEF DESCRIPTION OF THE DRAWINGS

The accompanying drawings; which are included to provide further understanding of the invention and are incorporated in and constitute a part of this specification, illustrate embodiments of the invention. In the drawings.

DESCRIPTION OF THE INVENTION

Figure 1A:
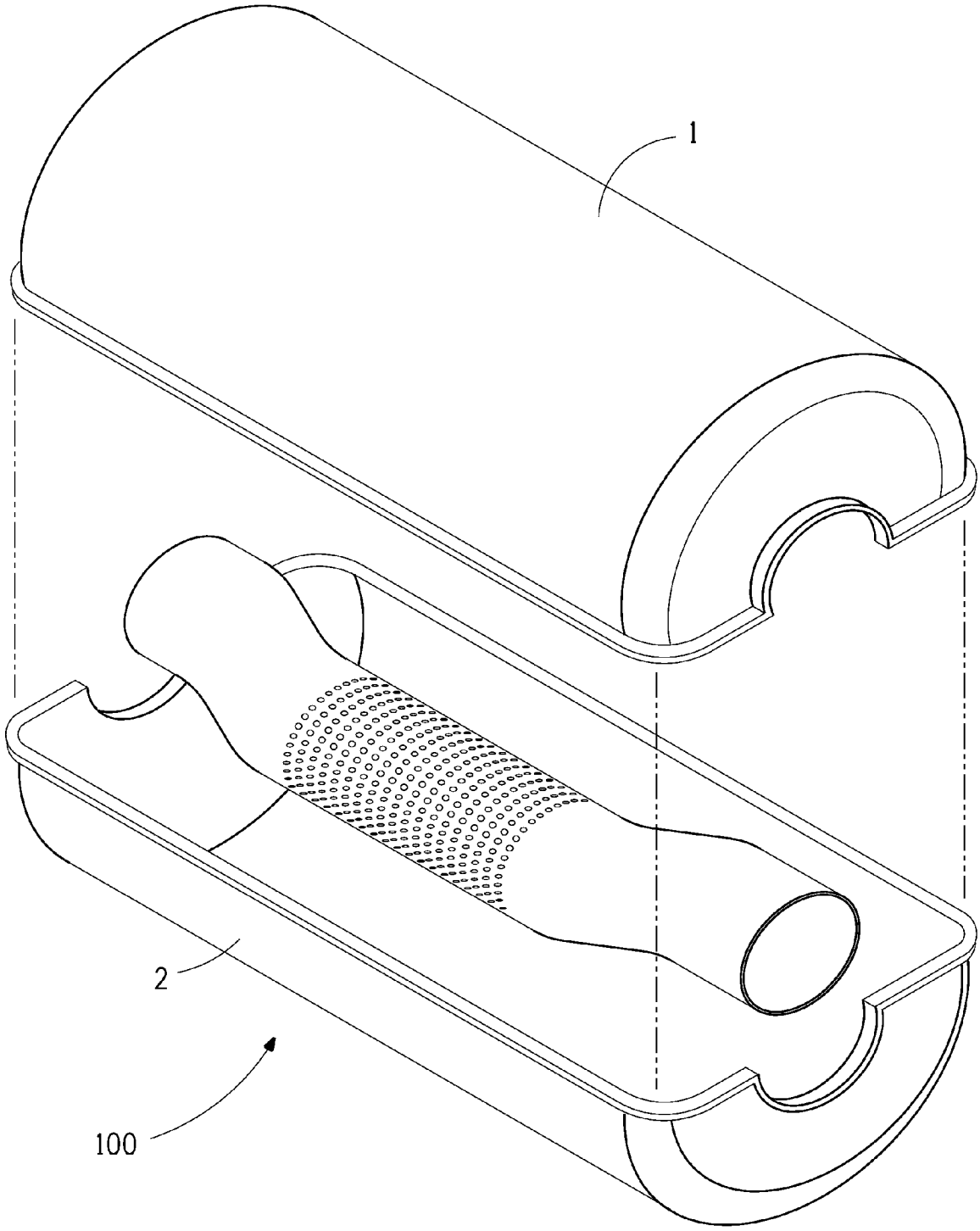
FIG. 1A is an exploded view of a muffler assembly showing a two piece polymeric housing.

By a "muffler assembly" is meant a complete muffler system comprising inlet and outlet exhaust pipes, any internal components such as baffles and additional pipes, and the polymeric housing. The muffler assembly meets the requirements for its intended end use such as automobiles, trucks, snowmobiles, motorcycles, static generators, and other equipment having an internal combustion engine.

By a "polymeric housing" is meant a muffler housing having a body (casing) made of a polymeric material, which may be any kind of polymer, including a thermoplastic, thermoset, or an infusible polymer. An infusible polymer is not crosslinked but does not become liquid before it reaches its decomposition temperature. The polymeric housing is the outer part of the muffler assembly and completely surrounds the internal components of the muffler assembly with openings or opening only for the inlet and outlet exhaust pipes. The polymer may comprise any other materials usually found in such compositions such as fillers, reinforcing agents, stabilizers, pigments, antioxidants, and lubricants. It includes both thermoset and thermoplastic polymeric materials.

By an "inlet exhaust pipe" is meant the pipe leading from the engine to the muffler assembly and which carries the exhaust gases into the muffler assembly. Typically the engine exhaust pipe goes through a catalytic converter before going to the muffler assembly if the exhaust system is an automotive exhaust system.

By an "outlet exhaust pipe" is meant the pipe exiting from the muffler assembly and which carries the exhaust gases away from the muffler assembly.

By "direct contact" is meant the part is physically touching another part. If a part is connected to another part by a brace, strap, or other connecting device, the two parts and not in direct contact with each other.

By "thermal insulating layer" is meant a layer or coating of material of sufficient thickness to thermally protect the item it is coating or layered onto without causing decomposition or a change in physical properties of the material it is coated onto.

The term "seal" means to partly close off or make impervious. A seal is a substance or material which prevents, inhibits, or reduces gas flow from one side of the seal to the other side.

By "interface" is meant the surface formed or created by the common boundary of the surfaces of two articles.

By "normal operating conditions" is meant conditions where the ambient aft temperature (air temperature external to the muffler assembly) are between −40 and 50° C. and the internal combustion engine is operating within its designed RPM range, under designed loading and conditions.

By "perforated" is meant having a hole or a series of holes which allows a gas to pass through.

By a "first body mounting adapter" is meant an adapter which holds the muffler body in position relative to the exhaust pipe, and is on the end of the muffler closest to the engine.

By a "second body mounting adapter" is meant an adapter which holds the muffler body in position relative to the perforated exhaust pipe, and is on the end of the muffler furthest away from the engine.

The term "chamber" means an area within a muffler assembly created by internal baffles, polymeric housing, or body mounting adapter, or any combination of these. The chamber may be completely sealed except for the opening for the exhaust pipe(s) or the chamber may only be partially sealed.

By "internal baffles" is meant a series of one or more dividing plates used to create two or more acoustic chambers within the muffler assembly. A muffler assembly without any baffles constitutes a single acoustic chamber. A baffle is a partition that regulates and directs the exhaust gas flow through the muffler assembly By "partition" is meant the act or process of dividing something into parts or sections.

By "interior" or "inner" is meant the inside or inner part of an assembly or housing.

By "inner shell" is meant a structure or framework which is capable of supporting itself.

By "conforming" is meant to follow the shape or contours of an object, article, or structure and to be in continuous contact with the object or structure.

By "layer" is meant a thickness of some material laid on or spread over a surface. The term "coating" and "layer" have the same meaning for purposes of this invention.

By "foam" is meant a material having air or gas cells within a polymeric, inorganic, or organic matrix. Also included within the definition of air or gas cells are hollow glass spheres having air, gas, or a vacuum inside the glass spheres.

By "rigid foam thermal insulation material" is meant a material which is strong enough to be free standing without additional support and is a foam.

By "assembling" is meant to put or fit components, sections, or pieces together to form a complete or whole object.

By "enclosing" or "encasing" is meant the act of surrounding something with something else on all sides By "sections" is meant a self-contained and distinct part of a larger whole. When all the sections are assembled together they form the complete and whole object.

By "adhering" or "attaching" is meant the chemical or mechanical joining of two or more sections at their interface so that the joined objects form a whole.

By "aerogel" is meant a highly porous solid formed from a gel, such as silica gel, in which the liquid is replaced with a gas by a process such as supercritical drying.

By "inserting" is meant to put, set, or introduce an object into something

By "inflatable tube" is meant a tube which is capable of being inflated with air or a gas resulting in the tube expanding in size.

By "curing" is meant the toughening or hardening of a material by the use of chemical additives, catalysts, ultraviolet radiation, heat or chemical reactions. For polymeric materials, curing is the chemical crosslinking of polymer chains.

By "overmolding" is meant a manufacturing process where molten polymeric materials are forced or injected into a mold cavity and then allowed to cool and harden to the configuration of the mold cavity.

By "folded over" is meant to bend something over onto itself so that the thickness of the material after folding over once is the thickness of approximately two layers of the material versus the thickness of the material before folding.

Reflective mufflers use a combination of chambers and baffles to attenuate the sound level and frequencies to a specific profile that is both quieter and more pleasing to the ear than standard mufflers. New design concepts have been discovered which provide polymeric muffler systems having tunable acoustic properties and are lightweight compared to mufflers comprising all metal components.

Acoustical muffler assemblies typically comprise a housing for the internal components of the muffler system, the internal components, and inlet and outlet exhaust pipes. The internal components typically comprise inlet and outlet exhaust pipes which are continuations of the external inlet and outlet exhaust pipes. Optional are additional internal pipe(s) used for acoustical tuning of the muffler assembly. Baffles can also be used as internal components, optionally in combination with additional internal pipe(s), and are also used for acoustical tuning purposes.

Polymeric Housing

The housing of the muffler assembly of the invention comprises a polymeric material. Preferred polymers for the polymeric housing are thermoplastic polymers. The polymer of the polymeric housing is preferably temperature resistant enough to withstand temperatures experienced during normal operation of the muffler assembly.

Figure 1B:
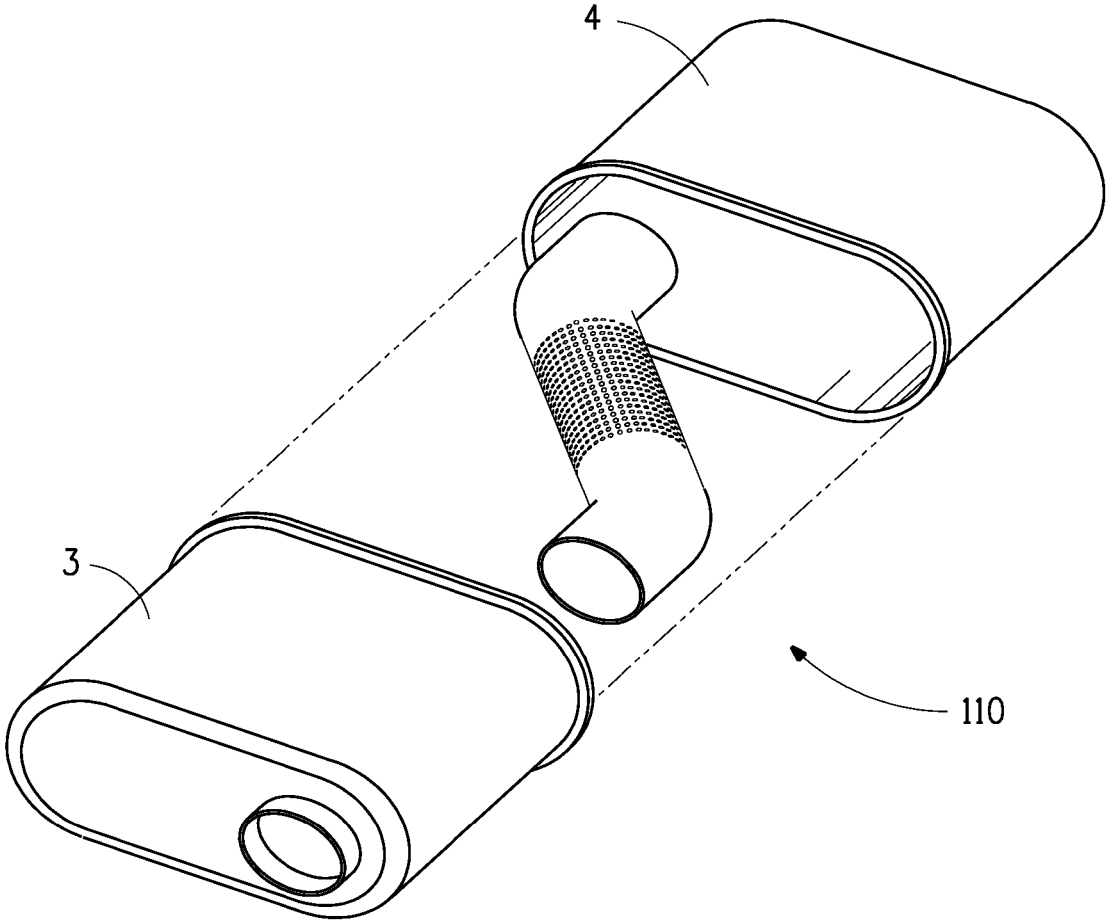
FIG. 1B is an exploded view of a muffler assembly showing a two piece polymeric housing.

The polymeric housing may be manufactured as a single part or may comprise more than one part. If the polymeric housing comprises more than one part, the housing is preferably split into two halves or sections. Preferably, the housing of the muffler assembly 100 is split longitudinally as shown in FIG. 1A. The housing can be split with a left half and a right half or a top half 1 and a bottom half 2. The housing may also be split along the cross section of muffler assembly 110 with a front half 3 and a back half 4 as shown in FIG. 1B. Although the polymeric housing may be split into more than two sections, it is not preferred but may be necessary due to space limitations within the automobile or other end use location. The polymeric housing may be extruded or molded in two halves which are then joined, perhaps by one or more separate exterior clamps, or the two parts may "snap fit" together, and/or be joined by a high temperature adhesive, or be welded together, for instance by laser welding or vibration welding. A high temperature sealant may be also be used to ensure no gas leakage from the joint(s) formed by the two halves. The halves or sections, when combined together, form the polymeric housing of the muffler assembly, with openings or opening to allow for the inlet and outlet exhaust pipes.

Wall thickness of the polymeric housing may vary across the housing cross section. For example, in a vehicle it may be an advantage for the bottom surface of the polymeric muffler body to be thicker than the top surface or for the front and rear of the polymeric housing to be thicker to provide additional structural strength and/or impact resistance to the polymeric housing.

The polymeric housing may be formed by any number of methods such as injection molding, extrusion, blow molding, rotomolding, reaction injection molding (thermosets especially), and compression molding.

The inlet and outlet exhaust pipes may enter and exit the polymeric housing at any location. Typically, the inlet and outlet exhaust pipes enter at opposite ends of the polymeric housing or the inlet and outlet exhaust pipes may be located on the same side of the muffler assembly. The location of the inlet and outlet exhaust pipes on the polymeric housing is determined by packaging or design limitations of the automobile, generator or other equipment in which the muffler assembly is used. Another design option is where there is only one opening in the muffler assembly for the inlet and outlet exhaust pipes, In such a design, the inlet exhaust pipe is housed within the outlet exhaust pipe in a tube within a tube design.

There may be more than one inlet or outlet exhaust pipe used in a muffler assembly. For example, there may be one inlet exhaust pipe and two outlet exhaust pipes in a muffler assembly design where dual exhausts are desired.

The polymeric composition used in the manufacture of the polymeric housing may include 0 to about 60 weight percent of one or more reinforcement agents. If a reinforcement agent is used, it is from less than 1 percent to about 60 weight percent of the composition, preferably from about 10 to about 60 weight percent. Weight percent is based on the combined weight of the polymeric materials used and the one or more reinforcing agents.

The reinforcement agent(s) used in the polymeric housing may be any filler, but is preferably selected from the group consisting calcium carbonate, glass fibers with circular and noncircular cross-section, glass flakes, glass beads, carbon fibers, talc, mica, wollastonite, calcined clay, kaolin, diatomite, magnesium sulfate, magnesium silicate, barium sulfate, titanium dioxide, sodium aluminum carbonate, barium ferrite, potassium titanate and mixtures thereof.

The polymeric housing of the muffler assembly of the invention comprises a thermal insulating material or mixture of materials coated or layered onto the inner or interior surface of the polymeric housing. The thermal insulating material can be attached to the inner surface of the polymeric housing through the use of standard techniques such as chemical adhesives, fasteners such as rivets, through overmolding of the insulation material during molding of the polymeric housing, through the use of welding techniques such a vibrational and ultrasonic welding, or through the use of a process for the mechanical attachment of a non-woven fiber mat onto the surface of a thermoplastic sheet as disclosed in US 2004/0188027, the content of which is incorporated herein by reference. The composite sheet of US 2004/0188027 can be used herein as the thermal insulating material which may be bonded to the polymeric muffler housing.

US2004/0188027 discloses a composite sheet having a base layer of reinforcing fiber impregnated with a thermoplastic resin and a non-woven fiber mat adjacent to the base layer. The non-woven fiber mat is partially impregnated with the thermoplastic resin of the base layer to provide a bondable surface that can be subsequently bonded to other materials, such as plastics, foam and metal. Such a composite sheet exhibits a mechanical bond between the base layer and the mat to provide a bondable surface with the non-impregnated surface of the non-woven fiber.

Such a composite sheet may be formed by heating and compressing the thermoplastic resin against the reinforcing fibers of the base layer and against the non-woven fibers, such that the base layer may be fully impregnated while the non-woven fibers may be partially impregnated. The thermoplastic resin must have a melting point less than either the reinforcing fibers of the base layer or the non-woven fibers.

In ultrasonic welding, vibration energy is used to briefly melt the polymer in a localized area and allow the molten polymer to flow into the surface layer of the lightweight thermal insulating material to securely bond the insulating material to the polymeric casing.

Thermal Insulating Material

The thermal insulating materials can be any material which provides thermal protection for the polymeric housing and does not thermally degrade at normal muffler operating temperatures. The thermal insulating material simultaneously seals the interfaces or gaps between the exhaust pipes or body mounting adapters and the polymeric housing as well as providing thermal protection for the polymeric housing.

The thermal insulating materials can be woven or non-woven inorganic fiber mats. Preferred mats include glass fiber or rock fiber mats. These mats must be applied using a sufficient number of layers and compressed enough between the body mounting adapter or exhaust pipe and polymeric housing to seal the interface between the body mounting adapter or exhaust pipe and polymeric housing. The number of layers needed can easily be determined by one of skill in the art by determining the gap width of the interface between the polymeric housing and exhaust pipes and the corresponding thickness of each mat layer such that when the polymeric housing comprising the thermal insulating material is placed around the internal components to form the muffler assembly, the interface created by the polymeric housing and exhaust pipes or body mounting adapters is sealed. Additional examples of thermal insulating materials include mats comprising an aerogel. Aerogels are defined as materials that possess no less than 50% liquid free porosity by volume and must be primarily mesoporous. Aerogels can be synthesized using a sol-gel process, and are typically based upon silica, metal oxides, organic polymers, or carbon. Aerogels are not foams. If metal oxides are used in the aerogel, they are not designed to be catalytically reactive with the exhaust gasses although they may be designed for this purpose.

The thermal insulation material can also be a foam or foamed insulating mat. Foamed materials are materials in which a substantial proportion of the volume of the foam is made up of small cavities, cells, or chambers filled with air or other inert gas (such as $CO_2$, nitrogen, or argon). The gas to solid ratio ranges from 90:10 to 30:70 volume percent. The volume ratio is the ratio of gas to solid on a volume basis. These foams can be made by mixing solid ingredients such as fly ash, silicates, gypsum, magnesium oxide, carbon, metal, or mixtures of them into a slurry or suspension in water or other solvent, optionally with small amounts of a binder, and introducing a foaming agent (an agent that releases gas under the influence of a catalyst and/or heat and/or decreased pressure). The foam slurry, dispersion, or suspension may then be applied to the polymeric housing by spraying, painting, molding, or other method known to one of skill in the art. The solvent can then be removed by heating, applying a vacuum with optional heating, or simple evaporation. Preferably, the foam slurry, dispersion, or suspension, is applied by spraying and the solvent removed by heating which may also activate the foaming agent. The foaming agent may also be activated by subsequently heating the muffler assembly. The resulting foam is a low density solid material in which a substantial proportion of the volume is gas. Organic foams can be made from an organic compound such as tannins (natural polyphenols) derived from Mimosa flowers, tree bark, or other organic source, furfuryl alcohol (derived from agricultural crops), and formaldehyde; or foam made from a high temperature polymer or infusible polymer. Inorganic foams are made from a metal or metal alloy; a foam made using the products of coal combustion (fly ash) as described in U.S. Pat. No. 7,744,693; a foamed ceramic (such as silica, alumina, or zirconia); foamed carbon; a foamed concrete or cement; or a foam made using inorganic material, such as silicates, bits of crushed rock, magnesium oxide, gypsum, or even mine tailings.

The thermal insulating material may also comprise glass spheres blended or mixed with other materials to prepare the thermal insulating material. Examples of glass spheres which may be used in the lightweight thermal insulating material are Poraver® glass granules available from Dennert Poraver GmbH. The size of the glass spheres may range from 0.04 mm to 16 mm, preferably from 0.1 mm to 8 mm, and more preferably 0.1 to 6 mm. The glass spheres may be mixed or blended with any thermal insulation material described herein. Preferred examples of these materials include geopolymners. Geopolymers are chains or networks of mineral molecules having covalent bonds and include but not limited to the following chain types:

—Si—O—Si—O— siloxo, poly(siloxo)

—Si—O—Al—O— sialate, poly(sialate)

—Si—O—Al—O—Si—O— sialate-siloxo, poly(sialate-siloxo)

—Si—O—Al—O—Si—O—Si—O— sialate-disiloxo, poly(sialate-disiloxo)

—P—O—P—O— phosphate, poly(phosphate)

—P—O—Si—O—P—O— phospho-siloxo, poly(phospho-siloxo)

—P—O—Si—O—Al—O—P—O— phospho-sialate, poly(phospho-sialate)

—(R)—Si—O—Si—O—(R) organo-siloxo, poly-silicone.

The thermal insulating material comprising glass spheres may be foams which are created by inclusion of blowing agents into the composition comprising the glass sphere. The blowing agents may be chemical or thermal in nature. Chemical blowing agents release the gas necessary to form the foam by a chemical reaction between two components, usually reactive with each other upon heating. Thermal blowing agents release a gas upon heating by a decomposition process.

The glass spheres may also be blended with other materials including aggregates such as concrete or cement, optionally comprising blowing agents. It is preferred that if concrete or cement materials are blended with the glass spheres, the blended composition is foamed to reduce weight of the concrete or cement mixture.

Preferred thermal insulating foams include mineral foams, such as those based upon fly ash, foams based upon geopolymer cements, and high temperature organic based foams, with geopolymer foams and tannin based foams being most preferred.

These thermal insulation foams can be applied directly to not only the polymeric housing interior surface but the surface of all the polymeric; components in the interior of the muffler assembly prior to assembly, during assembly, or after the unit is fully assembled. It is to be understood that when foams are used as the thermal insulation material, the foam can be applied using multiple methods. The foam composition, before foaming, may be molded, sprayed, painted, or applied my other means onto the polymeric housing surface. After applying the foam composition, the foam is activated, if necessary, to create the foam structure. Activation may be accomplished by heat or chemical reaction with or without the use of catalyst. It may be necessary to treat the interior surface of the polymeric housing with a high temperature adhesive, such as an epoxy, methacrylate, polyurethane, or other type of chemical adhesive, to insure that the foam material is securely bonded to the polymeric housing surface.

Figure 2A:
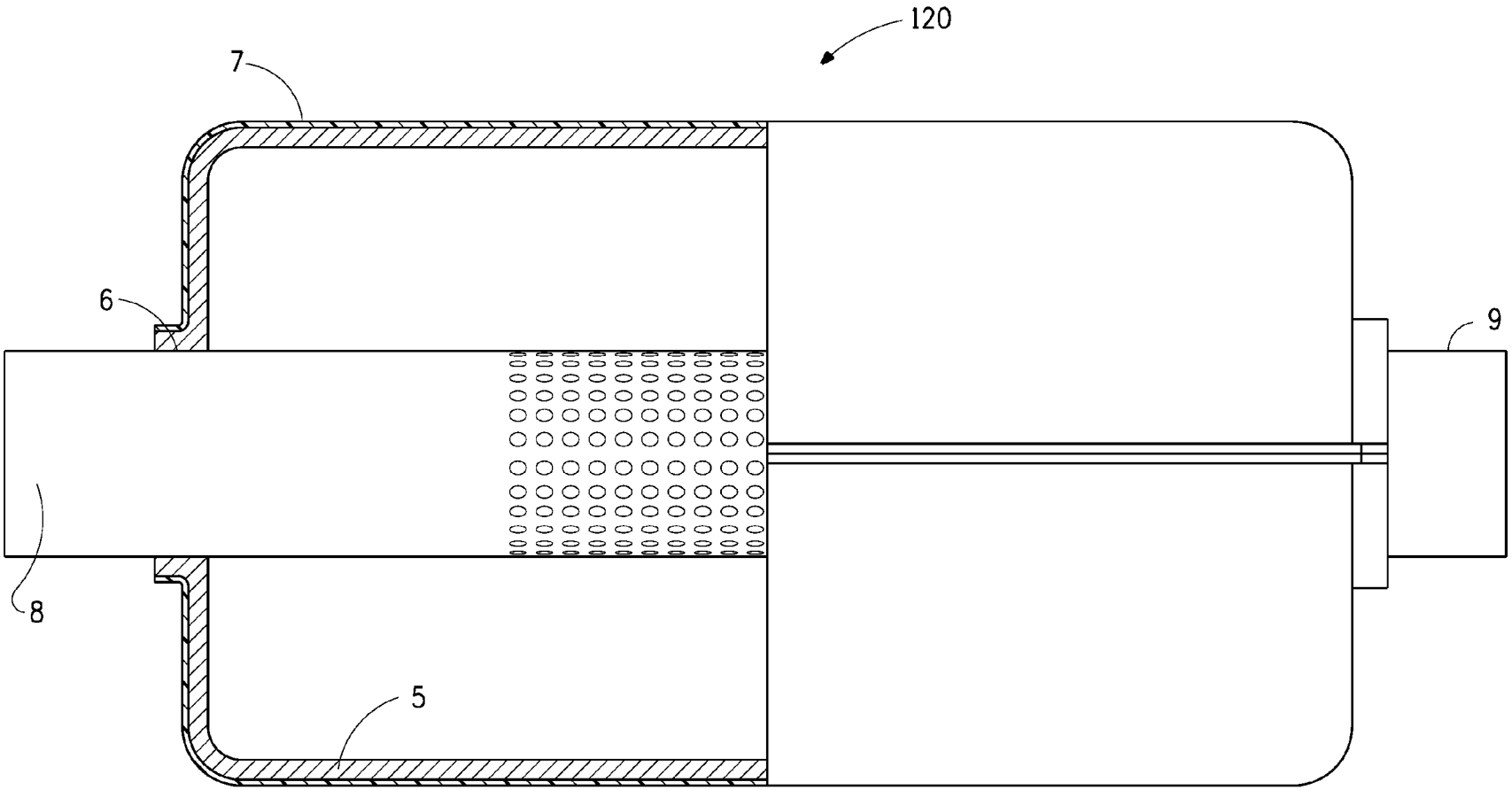
FIG. 2A is a cross-sectional view of a muffler assembly showing the thermal insulating layer and the sealing effect at the interface between the polymeric housing and the exhaust pipe.
Figure 2B:
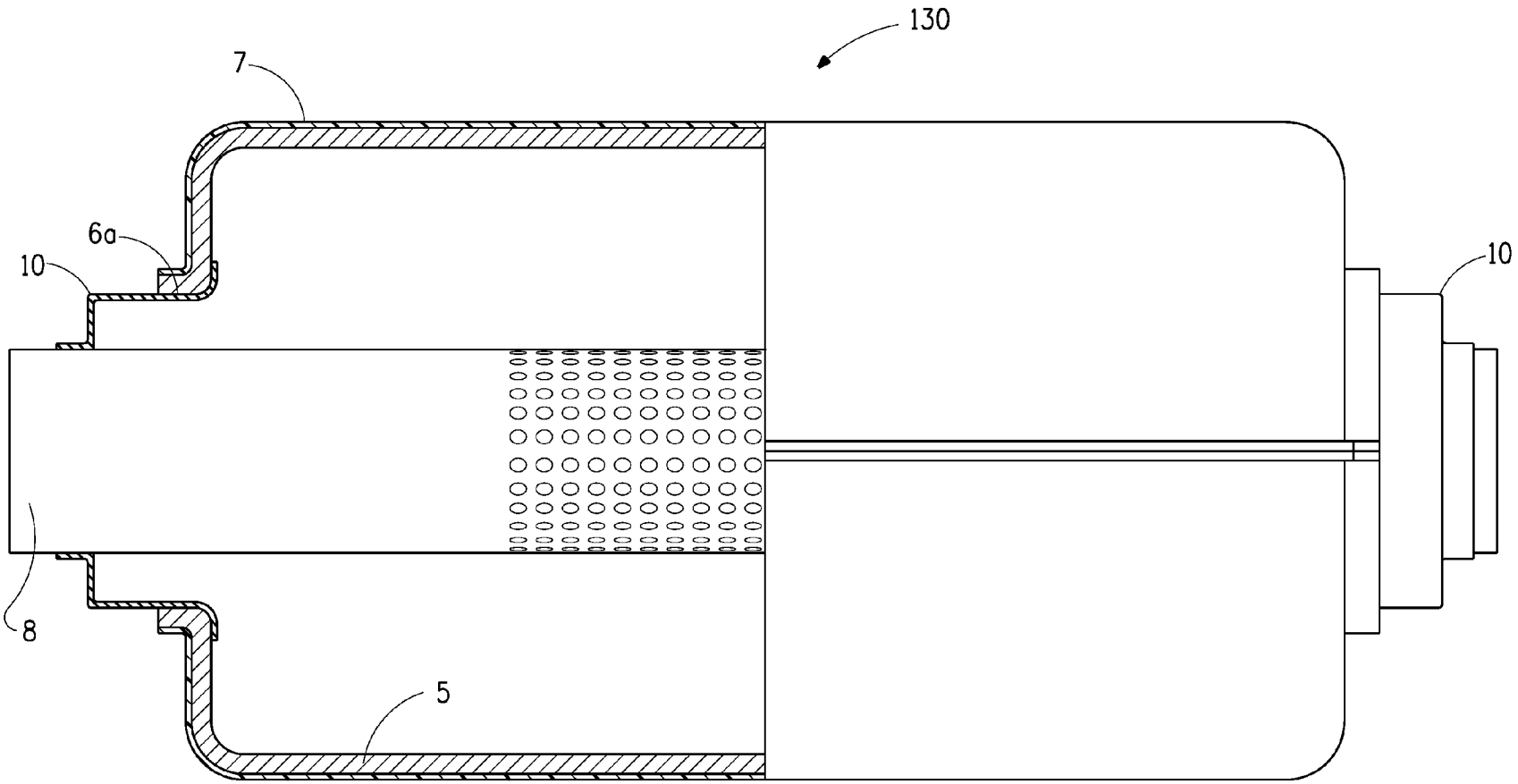
FIG. 2B is a cross-sectional view of a muffler assembly comprising a body mounting adapter.
Figure 2C:
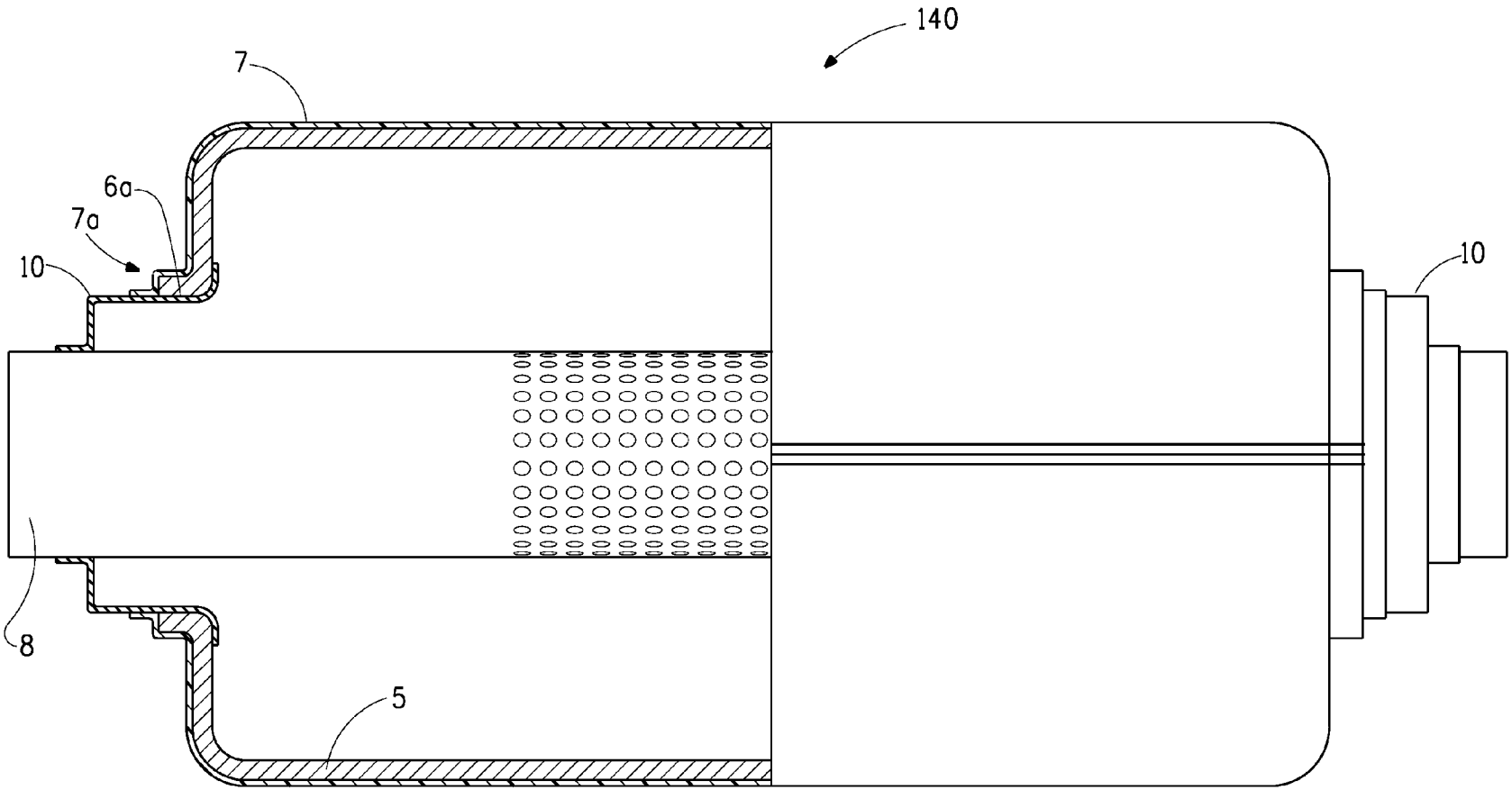
FIG. 2C is a cross-sectional view of a muffler assembly showing the polymeric housing contacting the body mounting adapter.

One advantage of using thermal insulation materials to coat the interior surface of the polymeric housing is the ability of the thermal insulation materials to act as both a seal and as thermal insulation. The thermal insulation material 5 of muffler assembly 120 may act as a seal at the housing-exhaust pipe interfaces 6 between the inlet exhaust pipe 8 and outlet pipe 9 and the polymeric housing 7 as shown in FIG. 2A without the need for any additional design elements such as a body mounting adapter or sealing flange(s) as taught in U.S. Pat. No. 7,810,609. It is important to seal the housing-exhaust pipe interface from a noise, vibration, and harshness (NVH) standpoint to prevent "whistling", and also to prevent hot gases from escaping between the interface of the pipes and polymeric housing. The thermal insulation sealing material acts to prevent localized thermal degradation of the polymeric housing due to concentration of high velocity, high temperature gases. In such a design, a body mounting adapter may not be necessary since the lightweight thermal insulation material acts to insulate the polymeric body from the exhaust pipes. However, if a body mounting adapter 10 is used, the thermal insulation material 5 may act as a seal at the housing-body mounting adapter interfaces 6*a* of the body mounting adapter 10 and the polymeric housing 7 (FIG. 2B). If a body mounting adapter is used, it is not necessary that the thermal insulation material act as a thermal barrier for the polymeric housing as shown in FIG. 2C. Temperatures of the body mounting adapter are cooler than the exhaust pipes and may allow the polymeric housing to contact the body mounting adapter at 7*a*. However, the thermal insulation layer still provides sealing properties at the interface 6*a*.

When the lightweight thermal insulating material which forms the interior surface of the polymeric housing is a foam, inorganic or organic fiber or mat insulation, or an aerogel, the thermal insulating material has a layer thickness of at least about 3 mm, preferably between 3 and 20 mm inclusive, and more preferably between 5 mm and 15 mm. The thermal insulating layer should be of sufficient thickness for the muffler assembly to operate within design specifications and under normal operating conditions of the muffler assembly for at least about 1000 hours, preferably more than about 2000 hours, more preferably at least about 3000 hours, and most preferably more than about 5000 hours of normal operation.

It is most preferable that the lightweight thermal insulation material coats or forms a layer on the entire interior surface of the polymeric housing and polymeric baffles, if present. It is preferred that 100% of the interior surface of the polymeric housing is coated with lightweight thermal insulation material. However, it may be advantageous in some embodiments of the invention to have less than 100% of the polymeric housing coated with lightweight thermal insulating material. It may be beneficial to use different insulating materials to coat specific interior areas of the polymeric housing. It is desirable that at least 50%, preferably 70%, even more preferably 90%, and most preferably 100% of the interior surface of the polymeric housing is coated with lightweight thermal material.

Figure 2D:
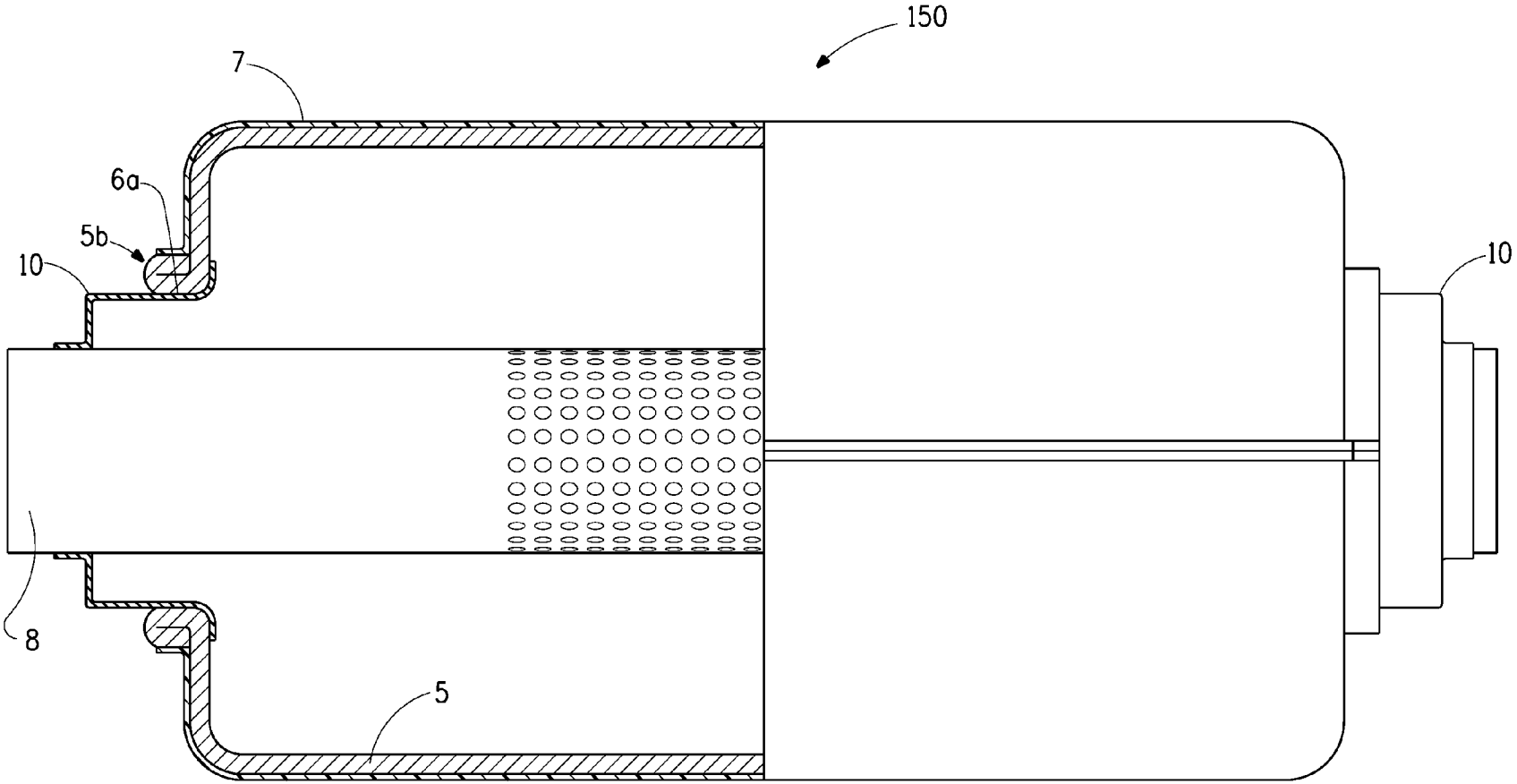
FIG. 2D is a cross-sectional view of a muffler assembly showing the thermal insulating layer folded over at the interface of the body mounting adapter and the polymeric housing.

Depending on the type of lightweight thermal insulation material used, it may be advantageous to fold over the thermal insulation material 5*b* onto itself one or more times at the housing-body mounting adapter interfaces 6*a* of the polymeric housing and exhaust pipe to improve sealing performance as shown in FIG. 2D.

Figure 3:
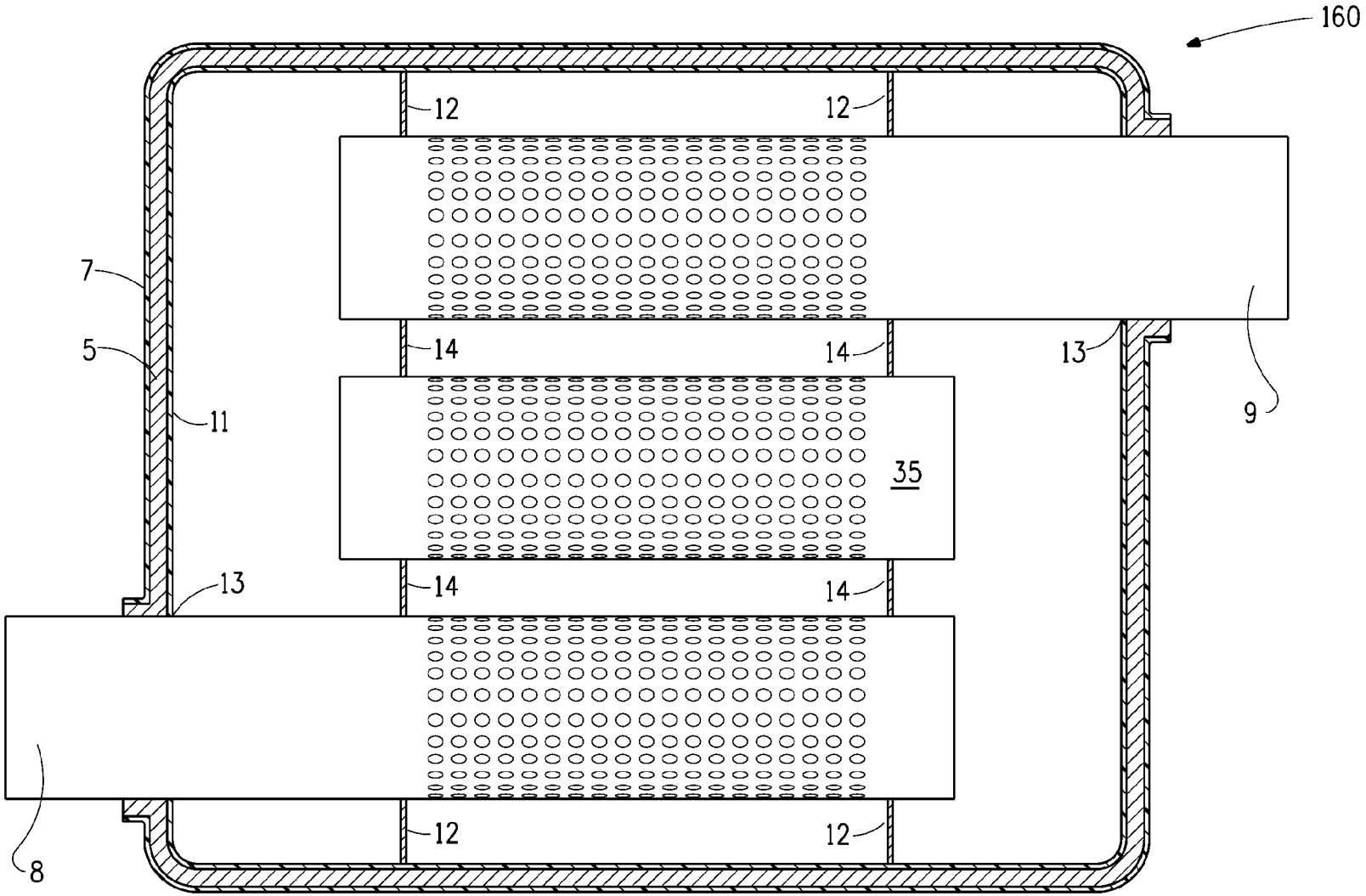
FIG. 3 is a cross-sectional view of a muffler assembly showing a metal inner layer and an internal perforated pipe where the exhaust pipes and internal pipe are connected to each other with metal supports.

Another design element of the muffler assembly is the use of a separate inner shell made from a thermoset polymer or, preferably, a metal such as stainless steel, aluminized steel, aluminum, aluminum alloy, or titanium. The lightweight thermal insulating material 5 of muffler assembly 160 would be sandwiched between the polymeric housing 7 and the inner shell 11 as shown in FIG. 3. The inner shell 11 would be relatively thin, and may be a solid layer or perforated with a plurality of uniform or non-uniform holes, a stiff wire mesh, or expanded metal. The inner shell is preferably at least 0.5 mm thick, more preferably at least 0.75 mm thick, and most preferably at least 1 mm thick. The inner shell may be thicker in the area around the exhaust pipes, the corners or edges of the muffler assembly, or any other area of the polymeric housing to provide additional structural support to the polymeric housing. The inner shell may be attached to the internal inlet exhaust pipe 8 or outlet exhaust pipe 9 using metal supports 12. This inner shell, if solid metal, may also provide a sealed acoustic chamber by being welded, furnace brazed, or attached by other means, directly to the exhaust pipes at point 13 where the exhaust pipes enter and exit the polymeric housing as shown in FIG. 3. Such an attachment would eliminate the need to provide a separate sealing material or sealing gasket between the exhaust pipes and the polymeric housing. However, there is still a need to protect the polymeric housing from the temperatures generated by the exhaust pipe by using a thermal insulating layer. The use of a body mounting adapter would be an optional component of such a muffler assembly.

Referring to FIG. 3, metal supports 14 are used to connect optional internal pipe 35 to the inlet and outlet exhaust pipes to provide a more rigid structure. If pipe 35 is not present, then the metal supports 14 are used to attach the inlet and outlet exhaust pipes to each other.

It is important that metal supports 12 do not penetrate completely through the thermal insulation layer 5 and make contact with the polymeric housing 7 which would expose the polymeric housing to high temperatures through thermal conduction of metal supports 12.

Figure 4:
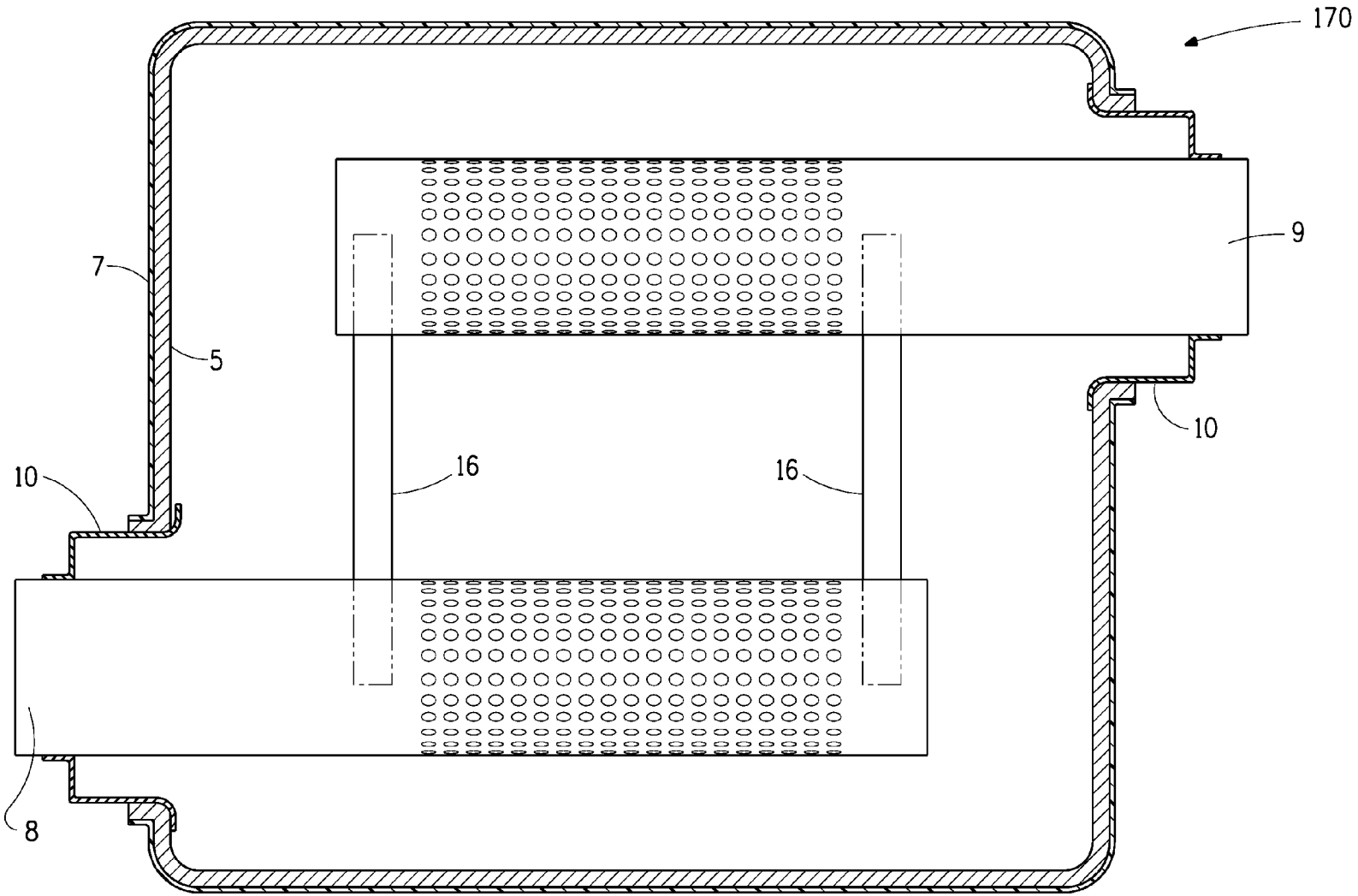
FIG. 4 is a cross-sectional view of a muffler assembly showing the exhaust pipes connected to each other with metal support brackets.

FIG. 4 shows muffler assembly 170 having inlet exhaust pipe 8 and outlet exhaust pipe 9 connected to each other using metal support braces 16 which provide additional stability and reduces vibration and movement of the exhaust pipes.

Internal Components

The acoustical muffler assembly may comprise any combination of internal pipe and/or baffle system enclosed within the polymeric housing depending on the acoustical properties desired. If both pipes and baffles are used as muffler assembly internal components, the combination is a pipe and baffle sub-assembly. The pipes may be manufactured from a metal or metal alloy such as titanium, steel, aluminum, aluminized steel, or stainless steel. The baffles may be manufactured from a high melting temperature thermoplastic polymer, a thermoset polymer, an infusible polymer or a metal or metal alloy. The polymeric baffles and polymeric housing may be molded as a single piece or molded as two halves or sections to further reduce cost and improve structural performance of the assembly. Although the baffle(s) and polymeric housing may be molded together in three or more sections and then attached to each other to form a polymeric housing, such a multi-component housing is not preferred.

If the pipe and baffle sub-assembly comprises polymeric baffles, it may be necessary to wrap or coat the polymeric baffles with the same or a different thermal insulating material used to coat the inner surface of the polymeric housing. When the baffles are coated with a thermal insulating material, the coating thickness is at least about 3 mm, preferably between 3 and 20 mm inclusive, and more preferably between 5 mm and 15 mm.

The coating for the baffles may be applied by methods known in the art. If the coating is in the form of a mat it must be laid down either by machine or manually by hand. If the coating can be applied in liquid form such as an aqueous or organic solvent suspension or solution it can be sprayed on.

Figure 5:
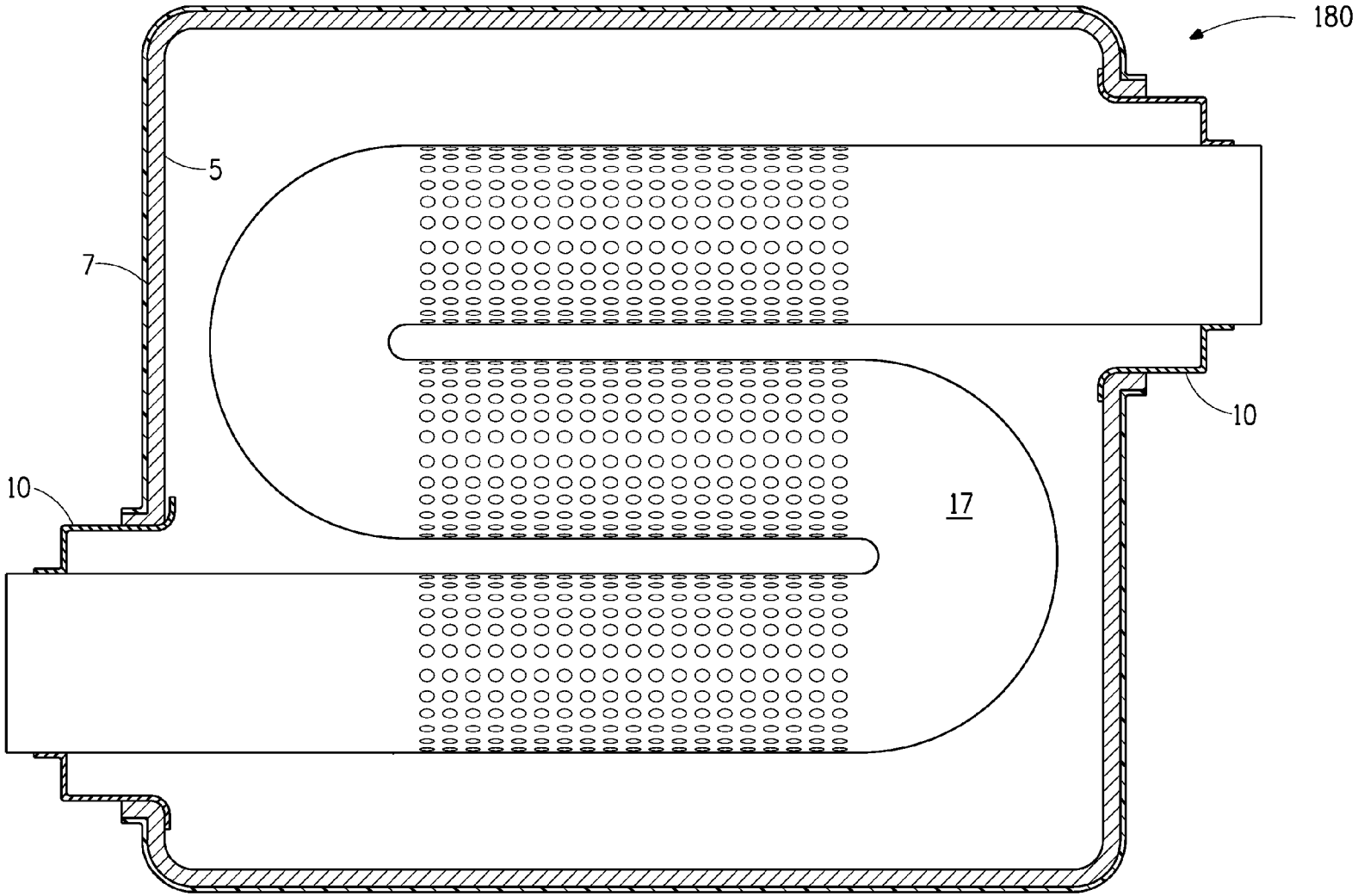
FIG. 5 is a cross-sectional view of a muffler assembly having one continuous exhaust pipe.

For acoustic tuning purposes, the pipe and baffle sub-assembly can be modified to alter acoustical behavior of the muffler assembly. In one embodiment, FIG. 5, the metal inlet exhaust pipe and a metal outlet exhaust pipe of muffler assembly 180 may be one continuous pipe 17 within the polymeric housing. The continuous pipe may have several turns within the polymeric housing and may or may not be perforated. The diameter of the pipe may also be varied.

Figure 6:
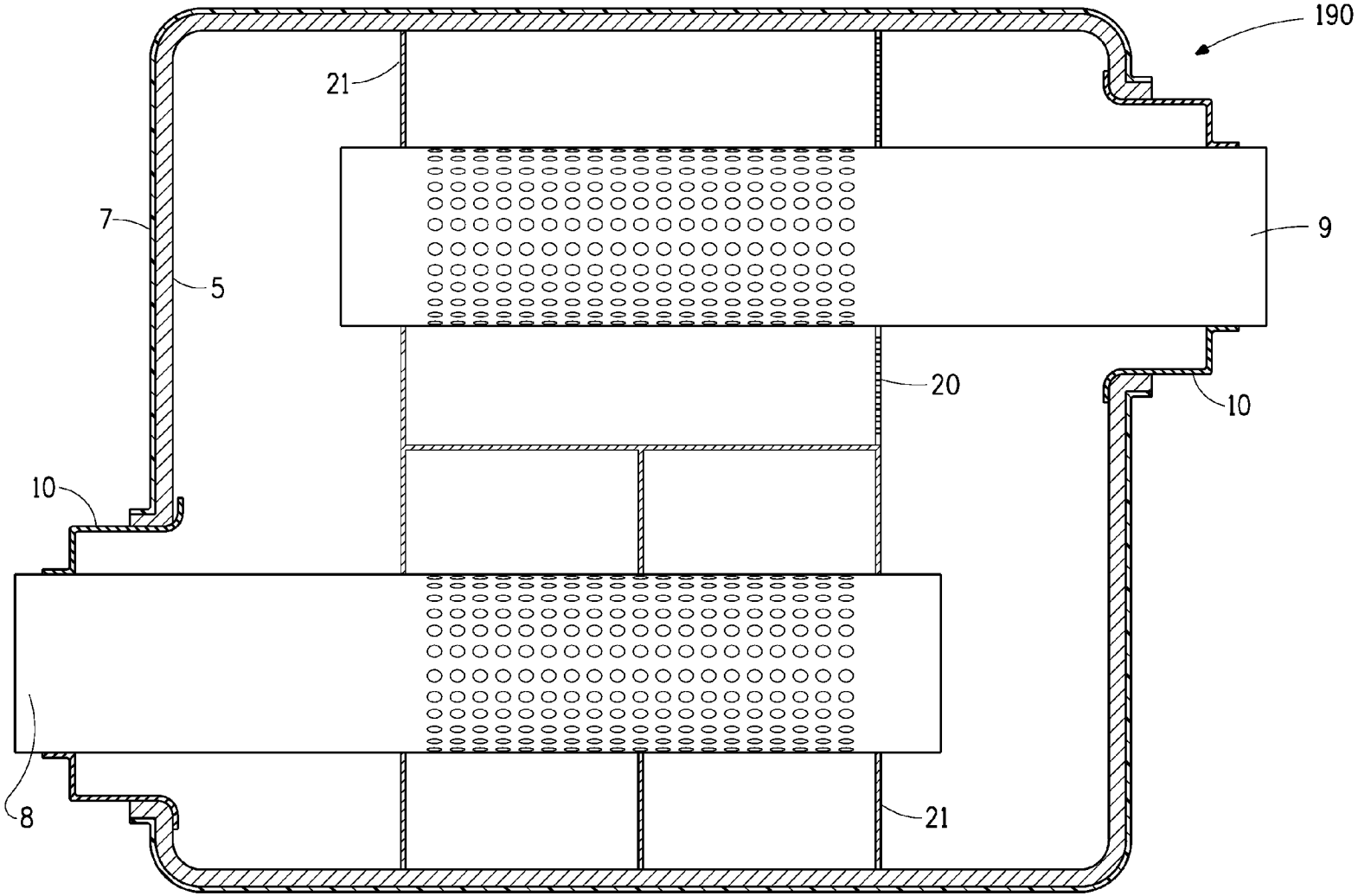
FIG. 6 is a cross-sectional view of a muffler assembly showing internal baffles.

Another embodiment, FIG. 6, is a muffler assembly 190 where the inlet 8 and outlet 9 exhaust pipes are separate pipes where the two pipes are not in direct physical contact with each other. However, the pipes may be attached to each other as shown in FIG. 6 by metal baffles 20 and 21 within the polymeric housing or the exterior of the pipes may touch each other or be welded to each other where the exterior of the pipes touch. Baffles 20 and 21 provide a dual function. The baffles provide additional acoustical chambers in the muffler assembly and also provide additional support to the inlet and outlet exhaust pipes. In the absence of baffles, support braces 16 such as those shown in FIG. 4 may be used to support the exhaust pipes within the muffler assembly. A preferred embodiment is where the pipes are not in physical contact with each other (not touching) and are supported by baffles 20 and 21. The inlet and outlet exhaust pipes can be of different lengths within the polymeric housing. For example, the inlet 8 or outlet 9 exhaust pipe may extend almost the entire length of the polymeric housing as shown in FIG. 6 or the exhaust pipe may be flush with the inside face of the thermal insulating material where the pipe enters or exits the assembly. The muffler assembly exhaust sound can also be tuned by the number, shape, and size of the perforation(s) in the pipe(s).

Figure 7:
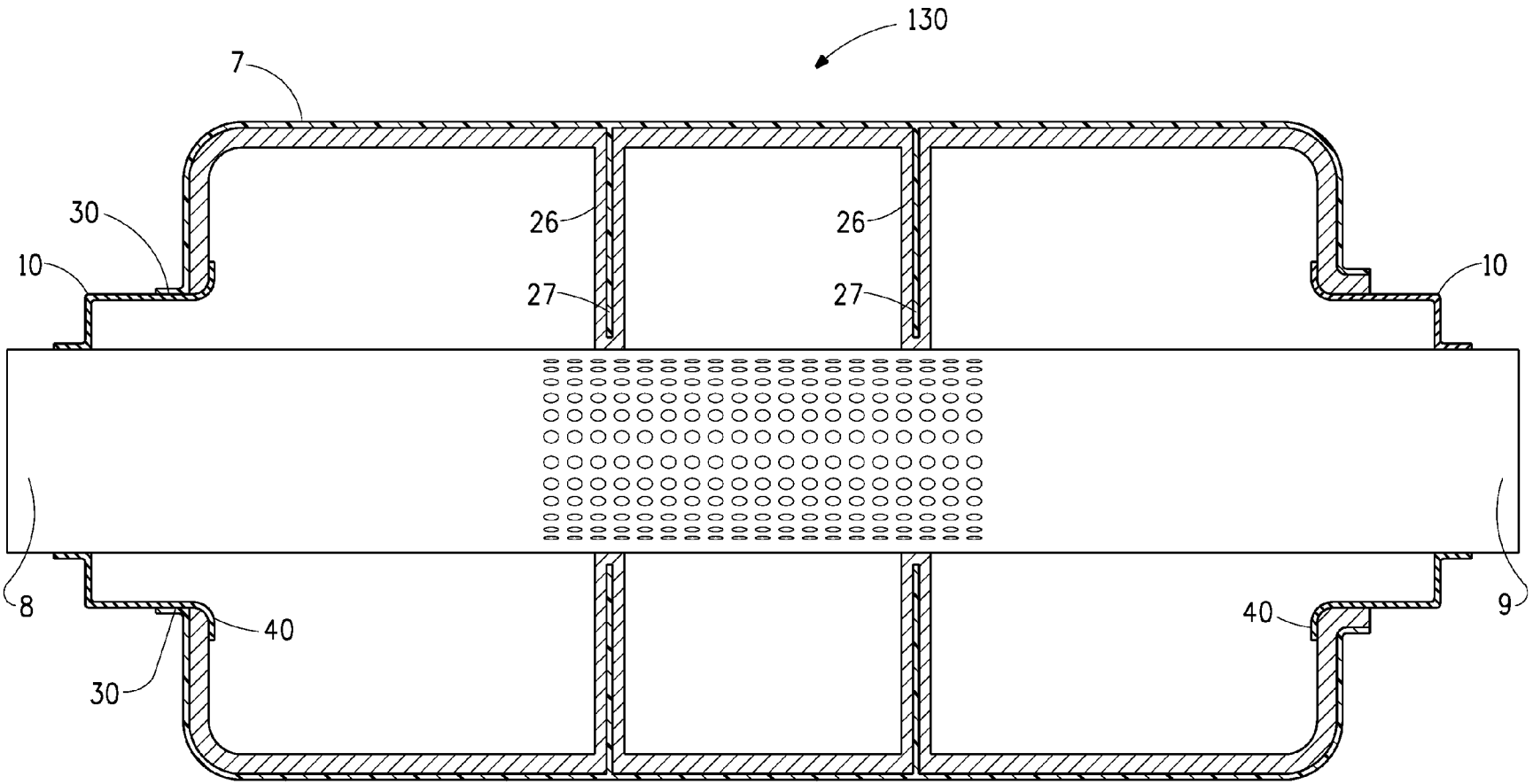
FIG. 7 is a cross-sectional view of a muffler assembly having polymeric baffles coated with thermal insulation and a body mounting adapter with a lip.

FIG. 7 shows muffler assembly 200 comprising a polymeric housing 7 with molded internal polymeric baffles 27. For this design, it is preferred the polymeric housing be molded in two sections or halves (not shown) in which each half of the polymeric housing is molded separately and form complementary halves of the polymeric housing assembly. The interior surfaces of the polymeric housing and molded molded internal polymeric baffles are coated with thermal insulation material 26 to protect the polymeric baffles from thermal degradation. The two complementary polymeric housing halves are connected together around the inlet and outlet exhaust pipes to form the complete muffler assembly. The muffler assembly of FIG. 7 shows optional body mounting adapters 10. The thermal insulation material 26 seals the interface 30 between the body mounting adapter 10 and the polymeric housing 7. It is preferred that the body mounting adapter has lip 40 to improve sealing properties of the thermal insulating material.

Another embodiment includes at least one additional metal pipe 35 which is totally enclosed within the muffler assembly as shown in FIG. 3. The additional pipe(s) may be perforated as in FIG. 3 or non-perforated. The additional pipe(s) can be any length as long as it is completely enclosed within the polymeric housing and permits exhaust gases to flow through it.

As discussed above, acoustical tuning can be accomplished by the use of baffles within the polymeric housing. The baffles can be used to create multiple acoustical chambers within the polymeric housing. Baffles can vary in height and width depending on the acoustical modifications desired. The baffles, if metal, may be welded to any metal pipe or a metal body mounting adapter within the polymeric housing, or may be attached to the metal components using a furnace braising process.

Figure 8:
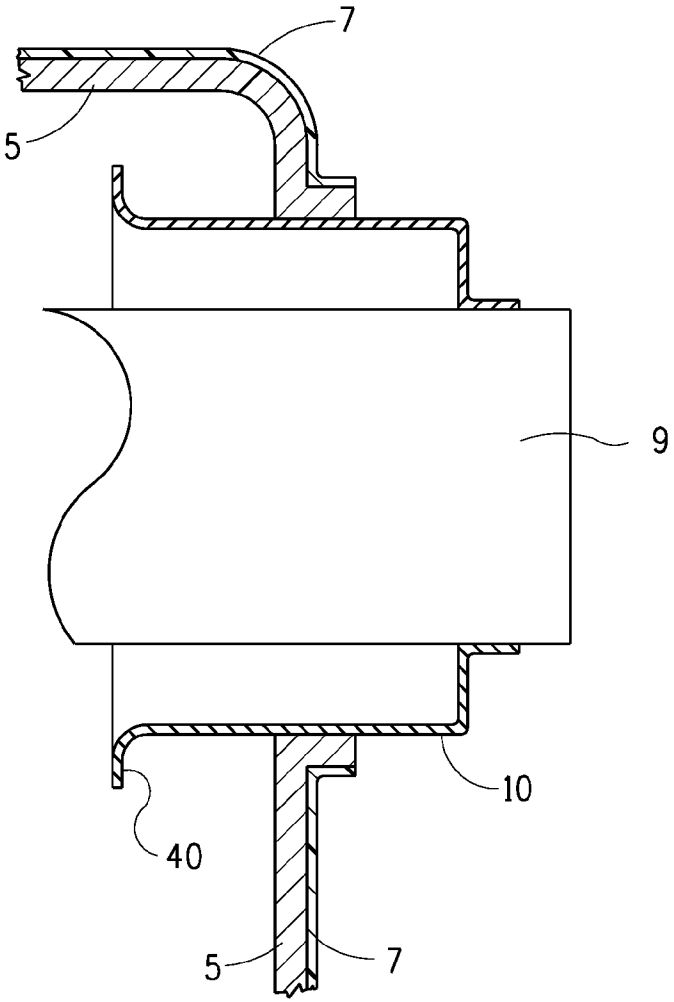
FIG. 8 is a cross-sectional view of a portion of a muffler assembly showing a lipped body mounting adapter extending partially into the muffler assembly.

The muffler assembly of the invention may optionally comprise body mounting adapters as described in US 2009/0194364 and 2010/0269344 and incorporated herein by reference. The body mounting adapters 10 can be attached to the inlet and/or exhaust pipes where the pipes enter and exit the polymeric housing as shown in FIGS. 2B, 2C, 2D, and 4-8. The body mounting adapters 10 may extend inside the polymeric housing the same distance as they extend outside the polymeric housing as shown in FIG. 8. The body mounting adapter extends far enough inside the polymeric housing such that when the pipes thermally cycle, the adapters do not "come out" of the muffler assembly exhaust pipe opening, A typical distance that the body mounting adapter extends along the exhaust pipe inside the polymeric housing is approximately 25 mm. Preferably, the body mounting adapter will have a lip 40 or extension which is perpendicular to the exhaust pipe and which prevents the adapter from coming out of the muffler assembly as shown in FIG. 8. The thermal insulation layer shown in FIG. 8 acts as a seal for the muffler assembly but not as thermal protection for the polymeric housing. It is not necessary that the body mounting adapters extend the entire length of the inlet or outlet exhaust pipes which are within the polymeric housing. The body mounting adaptors can be made of stainless steel, titanium, metal alloys, or other suitable materials that can withstand the thermal conditions and maintain the ability to hold the pipes an insulating distance from the polymeric housing. The inlet and outlet exhaust pipes would be joined to the body mounting adaptors to form a seal through a welding or furnace braising process.

The body mounting adapters may be the same or of different design for the inlet and outlet exhaust pipes. The body mounting adapters may be attached to the exhaust pipes (inlet and outlet) by a variety of methods. They may be welded, clamped, force fit, bolted or screwed to the exhaust pipes. It is usually undesirable to have exhaust gas leaking or escaping from between the exhaust pipe and the body mounting adapter interface. If the exhaust pipe is not completely welded to the body mounting adapter, gaps or holes may be present at the interface allowing gases to escape from the muffler assembly. If welding of the exhaust pipe and the body mounting adapter is not desired, a high temperature mastic or similar material may be used to seal the joint or gap between the exhaust pipe and the body mounting adapter.

Depending on the design and operating parameters of the muffler assembly, it may be necessary for the thermal insulating layer to extend beyond the edge of the polymeric housing to form a gas tight seal at the interface of the body mounting adapter and the polymeric housing.

The polymer used in the manufacture of the polymeric housing and baffles should be temperature resistant enough to withstand temperatures that it may be heated to by the exhaust gases. Useful materials for these polymeric housings include thermoplastics selected from the group consisting of semicrystalline polyamides, thermotropic liquid crystalline polymers, polyesters, polyacetals, and thermosetting resins selected from the group consisting of epoxy, melamine and phenolic resins, and infusible polymers selected from the group consisting of polyimides, poly(p-phenylenes), and polymers comprising greater than 50% repeat units the formula

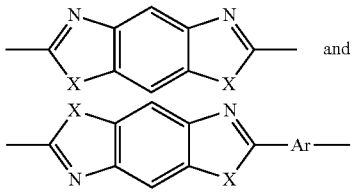

wherein X is NH, N-Phenyl, O (oxygen) or S (sulfur), and Ar is p-phenylene, 4,4'-biphenylene or 1,4-naphthylylene. The polymeric muffler housing must be capable of withstanding the high exhaust temperatures to which it may be exposed, for example by direct contact with exhaust gases and/or being heated by thermal conduction. However, the muffler assemblies described herein are not designed to permit the polymeric housing to come into direct contact with the inlet and outlet exhaust pipes but the polymeric housing may come into direct contact with body mounting adapters.

Polymers for the polymeric housing are thermoplastic polymers such as fully aliphatic polyamides and partially aromatic polyamides. Examples of fully aliphatic polyamide resins include PA6; PA6,6; PA4,6; PA6,10; PA6,12; PA6,14; P 6,13; PA 6,15; PA6,16; PA11; PA 12; PA10; PA 9,12; PA9,13; PA9,14; PA9,15; PA6,16; PA9,36; PA 10,10; PA10, 12; PA10,13; PA10,14; PA12,10; PA12,12; PA12,13; PA12, 14 and copolymers and blends of the same. Preferred examples of fully aliphatic polyamide resins comprised in the polyamide compositions described herein include PA6; PA11; PA12; PA4,6; PA6,6; PA,10; PA6,12; PA10,10 and copolymers and blends of the same.

Especially preferred thermoplastics are partially aromatic polyamides. By partially aromatic polyamides is meant that some, but not all, of the repeat unit in the polyamide contain aromatic rings. Useful partially aromatic polyamides include copolyamides of 1,6-hexanediamine, terephthalic and/or isophthalic acids, and optionally adipic acid, and polyamides derived in whole or part from one or more of the following monomers, $H_2N(CH_2)_mNH_2$ wherein m is 4 to 14, $HO_2C(CH_2)_yCO_2H$ wherein y is two to 14, 2-methyl-1,5-pentanendiamine, isophthalic acid, terephthalic acid, 1,3-diaminobenzene, 1,4-diaminobenzene, and 4,4'-bibenzoic acid.

Preferred polyamides for the polymeric muffler body are polyamides having a melting point of at least 260° C., comprising (b) greater than 95 mole percent semiaromatic repeat units derived from monomers selected from one or more of the group consisting of:
  i) aromatic dicarboxylic acids having 8 to 20 carbon atoms and aliphatic diamines having 4 to 20 carbon atoms; and
(b) less than 5 mole percent aliphatic repeat units derived from monomers selected from one or more of the group consisting of:
  ii) an aliphatic dicarboxylic acid having 6 to 20 carbon atoms and said aliphatic diamine having 4 to 20 carbon atoms; and
  iii) a lactam and/or aminocarboxylic acid having 4 to 20 carbon atoms.

Preferred partially aromatic polyamides are selected from the group consisting of poly(tetramethylene terephthalamide/2-methylpentamethylene terephthalamide) PA4T/DT, poly(tetramethylene terephthalamide/hexamethylene terephthalamide) PA4T/6T, poly(tetramethylene terephthalamide/decamethylene terephthalamide) PA4T/10T, poly(tetramethylene terephthalamide/dodecamethylene terephthalamide)PA4T/12T, poly(tetramethylene terephthalamide/2-methylpentamethylene terephthalamide/hexamethylene terephthalamide) (PA4T/DT/6T), poly(tetramethylene terephthalamide/hexamethylene terephthalamide/2-methylpentamethylene terephthalamide) (PA4T/6T/DT), poly(hexamethylene terephthalamide/2-methylpentamethylene terephthalamide) (PA6T/DT), poly(hexamethylene terephthaldiamide/hexamethylene isophthalamide) (PA 6T/6I), poly(hexamethylene terephthalamide/decamethylene terephthalamide) PA6T/10T, poly(hexamethylene terephthalamide/dodecamethylene terephthalamide) (PA6T/12T), poly(hexamethylene terephthalamide/2-methylpentamethylene terephthalamide/poly(decamethylene terephthalamide) (PA6T/DT/10T), poly(hexamethylene terephthalamide/decamethylene terephthalamide/dodecamethylene terephthalamide) (PA6T/10T/12T), poly(decamethylene terephthalamide) (PA10T), poly(decamethylene terephthalamide/tetramethylene terephthalamide) (PA10T/4T), poly(decamethylene terephthalamide/2-methylpentamethylene terephthalamide) (PA10T/DT), poly(decamethylene terephthalamide/dodecamethylene terephthalamide) (PA10T/12T), poly(decamethylene terephthalamide/2-methylpentamethylene terephthalamide/(decamethylene terephthalamide) (PA10T/DT/12T). poly(dodecamethylene terephthalamide) (PA12T), poly(dodecamethylene terephthalamide)/tetramethylene terephthalamide) (PA12T/4T), poly(dodecamethylene terephthalamide)/hexamethylene terephthalamide) PA12T/6T, poly(dodecamethylene terephthalamide)/decamethylene terephthalamide) (PA12T/10T), and poly(dodecamethylene terephthalamide)/2-methylpentamethylene terephthalamide) (PA12T/DT); and a most preferred Group (I) Polyamide is PA6T/DT.

Preferred polyamide resins used in the present invention have a melting point of at least 260° C. Melting points are determined by differential scanning calorimetry (DSC) at a scan rate of 10° C./min in the first heating scan, wherein the melting point is taken at the maximum of the endothermic peak.

The polymeric composition may comprise any other materials usually found in such compositions such as fillers, reinforcing agents, stabilizers, pigments, antioxidants, lubricants, and fibrous materials. The polymeric composition used in the manufacture of the polymeric housing may include 0 to 60 weight percent of one or more reinforcement agents. If a reinforcement agent is used, it is from less than 1 percent to 60 weight percent of the composition, preferably from 10 to 60 weight percent. Weight percent is based on the combined weight of the polymeric materials used and the one or more reinforcing agents.

The reinforcement agent(s) used in the polymeric housing may be any filler, but is preferably selected from the group consisting calcium carbonate, glass fibers with circular and noncircular cross-section, glass flakes, glass beads, carbon fibers, talc, mica, wollastonite, calcined clay, kaolin, diatomite, magnesium sulfate, magnesium silicate, barium sulfate, titanium dioxide, sodium aluminum carbonate, barium ferrite, potassium titanate and mixtures thereof.

The fibrous material may be in any suitable form known to those skilled in the art and is preferably selected from non-woven structures, textiles, fibrous battings and combinations thereof. Non-woven structures can be selected from random fiber orientation or aligned fibrous structures. Examples of random fiber orientation include without limitation chopped fiber and continuous fiber which can be in the form of a mat, a needled mat or a felt. Examples of aligned fibrous structures include without limitation unidirectional fiber strands, bidirectional strands, multidirectional strands, multi-axial textiles. Textiles can be selected from woven forms, knits, braids and combination thereof.

Preferably, the fibrous material is made of glass fibers, carbon fibers, aramid fibers, graphite fibers, metal fibers, ceramic fibers, natural fibers or mixtures thereof; more preferably, the fibrous material is made of glass fibers, carbon fibers, aramid fibers, natural fibers or mixtures thereof; and still more preferably, the fibrous material is made of glass fibers, carbon fibers and aramid fibers or mixture mixtures thereof.

Muffler Assembly

The pipe and baffle sub-assembly can be manufactured external to the polymeric housing. Either pipes or baffles or both can comprise the internal components of the muffler assembly. If needed, some or all of the pipe and baffle sub-assembly components may be wrapped or coated with a relatively thin layer of thermal insulating material as discussed herein and then inserted into the extruded or molded polymeric housing. When the coating for the sub-assembly components is a foam, inorganic or organic fiber or mat insulation, or an aerogel, the thermal insulating material coating thickness is at least about 3 mm, preferably between 3 and 20 mm inclusive, and more preferably between 5 mm and 15 mm.

If the polymeric housing comprises two halves or three or more sections, the two halves or sections can be placed around the pipe and baffle sub-assembly and the joints or interface where the two halves or sections of the polymeric housing intersect are then sealed by high temperature mastic, gasket, o-ring, or similar sealing material. The polymeric joints may also be sealed by methods known in the art for joining polymeric materials such as fasteners, adhesives, ultrasonic welding, laser welding, or preferably vibrational welding. This seal is necessary in order to maintain a gas leak rate of the muffler below the allowable maximum specified by the manufacturer or by government regulations. The method of sealing the interface of the two halves or sections of the polymeric housing may be different than the sealing method for the interface between the polymeric housing and exhaust pipe or body mounting adapter. Sealing between the polymeric housing and exhaust pipe or body mounting adapter is accomplished by the thermal insulating material lining the polymeric housing or by welding the metal inner layer to the exhaust pipe or optional body mounting adapter.

The thermal insulation material lining the polymeric housing may also act as a sealing material where the baffles intersect the thermally insulated polymeric housing. If the baffles are coated with a thermal insulation material, the thermal insulation material on the baffle may act to seal the interface between the baffles and the internal pipe(s) to provide a partially sealed acoustic chamber formed by the baffle(s).

When the baffles and polymeric housing are molded as one piece or section, the baffles are already sealed at the interface of the polymeric housing and baffle.

One element common to all the muffler assemblies of the invention is the void space(s) within the polymeric housing. The void spaces are the spaces between the thermal insulated polymeric housing and the muffler assembly internal components and the spaces between the various muffler internal components such as the pipes and baffles inside the polymeric housing. If the polymeric housing optionally comprises a metal inner layer wherein the thermal insulating polymeric layer is sandwiched between the metal layer and the polymeric housing, then the void spaces include the spaces between the metal inner layer and the exhaust pipes and other internal components. In order for the muffler assembly to function properly as an acoustical muffler assembly, the space between the thermal insulation layer of the polymeric housing and the polymeric housing internal components is void of any type of fill material. If the internal spaces within the muffler assembly were filled or packed with any type of organic or inorganic fill material, the ability to acoustically tune the muffler assembly through the reflection of sound waves may be compromised, and too much backpressure may be created within in the muffler assembly resulting in poor engine performance and lower mileage. The optional thermal insulating layer coating or surrounding the internal components of the muffler assembly are not considered fill material for purposes of this invention.

The lightweight muffler assemblies of this invention are especially useful in automobiles and trucks. However, the muffler assemblies can also be used to acoustically tune the sound of the exhaust of any internal combustion engine. In order to be used in automotive, truck, or bus applications, the muffler assemblies of the invention must have a leak rate, when tested at a pressure of 4.5 psig as described herein, of less than or equal to about 100 Liters/minute, preferably less than 80 Liters/minute, and more preferably less than 60 Liters/minute.

The following muffler assembly embodiments are preferred.

Muffler assembly 1 comprises a polymeric housing that is molded or extruded in two or more pieces or sections. When combined together, the polymeric housing pieces or sections form a complete polymeric housing of muffler assembly 1 with opening(s) to allow for inlet and outlet exhaust pipes to enter and exit the polymeric housing. Inside the polymeric housing, the inlet and outlet exhaust pipes may be any length, and may have one or more perforated areas, as long as the pipes do not create undesirable backpressure in the muffler assembly. Muffler assembly 1 optionally comprises at least one additional pipe, which may have one or more perforated areas, housed completely within the polymeric housing. Muffler assembly 1 also comprises a set of body mounting adaptors, one for the at least one inlet exhaust pipe and one for the at least one outlet exhaust pipe, where the pipes enter and exit the polymeric housing. Muffler assembly 1 also comprises at least one baffle designed to partition the internal space of the polymeric housing into multiple chambers for acoustic tuning purposes. The polymeric housing of muffler assembly 1 comprises a layer or coating of lightweight thermal insulation comprising an aerogel material, a foamed insulating mat, a rigid foam insulation material, a glass fiber fabric, a glass fiber mat, a rock fiber fabric, a rock fiber mat, tannin based foams, and mineral foams. Tannin based foams and mineral foams (e.g., fly ash based foams) are preferred lightweight thermal insulating materials for muffler assembly 1. The metal inlet and outlet exhaust pipes are joined to the body mounting adaptors through a welding or furnace braising process or other process used to weld metals together. If metallic baffles are used, these metallic baffles may also be welded to the portion of the inlet and outlet metal exhaust pipes which are housed within the polymeric housing. If polymeric baffles are used, they may or may not be molded out of the same material as the housing, and preferably, would be of the same material and be incorporated into the polymeric housing (i.e., baffle and housing section molded as a single piece). Optionally, some or all of the components within the polymeric housing may be coated with a layer of thermal insulating material. The combination of baffles and pipes that are to be located within the polymeric housing may be assembled outside the polymeric housing and then the two or more polymeric housing sections placed around the assembled pipes and baffles to form muffler assembly 1. The two or more sections of the polymeric housing would be joined to each other as previously described. The thermal insulation layer lining the inside the polymeric housing may act as a sealing material between the body mounting adaptors, if present, and the polymeric housing. If no body mounting adapters are present, the thermal insulation layer acts as a sealing material between the polymeric housing and the inlet and outlet exhaust pipes as well as acting as a thermal barrier for the polymeric housing. Because the thermal insulation layer acts as both a sealant and as thermal insulation, a separate seal such as an o-ring or gasket is not necessary to seal the gap between the body mounting adapter and polymeric housing or between the inlet and outlet exhaust pipes and the polymeric housing. The gap between the polymeric housing and body mounting adapter or exhaust pipes must be sealed in order to minimize exhaust gas leakage of the muffler assembly. The muffler assembly must be capable of passing the exhaust gas leakage test of the end user or government regulations.

Muffler assembly 2 comprises muffler assembly 1 and additionally comprises a polymeric housing having an inner shell made from thermoset polymer or, more preferred, metal. The inner shell sandwiches the thermal insulation layer between the polymeric housing and the inner shell. The inner shell may provide additional support for the thermal insulation layer. This inner shell may contain a plurality of perforated holes to help improve the acoustic performance of the muffler as well as to reduce the weight of the muffler assembly. The inner shell may also be made using a metallic mesh or expanded metal or foil.

Muffler assembly 3 comprises a polymeric; muffler housing which is molded in two or more pieces, with polymeric baffles molded into one or more of the pieces to produce a series of two or more chambers or baffles within the final muffler assembly for acoustic tuning purposes. The inlet and outlet exhaust pipes and, if present, internal pipes, are preferably joined together by a series of metal straps or braces welded or attached by other means to each pipe to provide structural support and proper spacing of the pipes and to reduce vibration of the pipes. The polymeric housing pieces would then be assembled around the pipes and joined using one of several possible techniques, including fasteners, adhesives, or a welding process, such as ultrasonic welding, laser welding, or vibrational welding. The thermal insulation layer of the polymeric housing acts as a seal and thermal barrier between the exhaust pipes and the polymeric housing or if body mounting adaptors are present, between the polymeric housing and the body mounting adapters. This seal is necessary in order to maintain a leak rate of the unit below the allowable maximum specified by the manufacturer or by legal regulations.

Muffler assembly 4 comprises a polymeric housing formed as a single piece. The polymeric muffler body may or may not have a constant cross sectional area through the length of the body, and it may or may not have a uniform wall section through the length or width of the body, as having a thicker wall section on the bottom portion of the unit may provide improved protection from impact and stone impacts. Such a polymeric housing is preferably made by extrusion. After extrusion, the extrudate is cut to the length required. Extrusion is a relatively inexpensive method of forming polymeric, especially thermoplastic parts.

Figure 9:
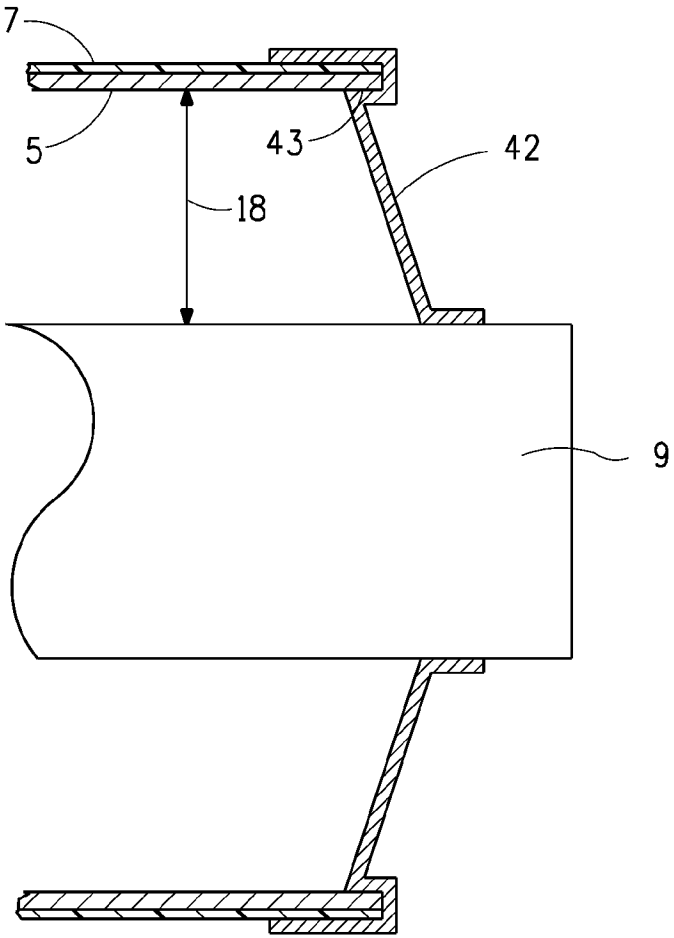
FIG. 9 is a partial cross-sectional view of a muffler assembly showing an extruded polymeric housing wherein the body mounting adapter is the end plate of the muffler assembly.

A thermal insulation layer is then attached to the inside surface of the extruded polymeric housing either through the use of a high temperature adhesive or mechanical means mentioned previously such as rivets, fasteners, or ultrasonic staking. The internal components comprise at least one inlet and one outlet pipe and the pipes may contain sections of pipe that have a plurality of perforated holes. The internal components may also comprise one or more baffles to create a multitude of chambers. The internal components may be wrapped by an insulating material, such as an insulating foam material, a rock wool mat, or a rock fiber mat. The internal components are then slid or placed into the polymeric housing and a body mounting adaptor attached to each of the inlet and outlet exhaust pipes through a welding process. The body mounting adapters 42 form the front and rear end plates of the muffler assembly and results in void space 18 between the polymeric housing 7 and the exhaust pipe 9 as shown in FIG. 9. The thermal insulation layer 5 of the polymeric housing 7 acts as a seal at interface 43 between the polymeric housing and the body mounting adaptors 42 as shown in FIG. 9. This seal is necessary in order to maintain a gas leak rate of the muffler below the allowable maximum specified by the manufacturer or by legal regulations.

Muffler assembly 5 comprises muffler assembly 4 further comprising an inner metal layer attached to the polymeric housing thermal insulation layer. The metal inner shell helps to support the thermal insulation layer and may also act as an acoustical material. This inner shell could be made of solid sheet metal, a sheet of metal containing a plurality of perforations, a wire mesh, expanded metal, or a thermoset polymer. If the inner shell is made of solid sheet metal, it is preferred that the shell be welded to the exhaust pipes in order to provide the gas tight seal for the muffler.

Muffler assembly 6 comprises muffler assembly 1 wherein the thermal insulation layer comprises a cast-in-place foam material. The cast-in-place foam material may be applied to the polymeric housing prior to final assembly of the muffler or after the polymeric muffler housing has been welded together if more than a single piece or section. As the cast-in-place foam sets-up it would seal any and all openings available to it. In order to avoid sealing any perforations in the pipes with the cast-in-place foam, an inflatable tube would be placed within the pipes prior to assembly of the polymeric muffler body. The tube would be inflated so that the tube expands into the perforation openings of the exhaust pipes. The cast-in-place foam would be cured (i.e., expanded), and the inflatable tube would then be deflated and removed from the muffler assembly. Curing of the foam may be accomplished by heating, drying, or other means depending on the type of cast-in place foam used.

Muffler assembly 7 comprises a two piece polymeric housing and a metal inner shell, preferably a solid sheet, but optionally containing a plurality of perforations. The metal inner shell may also comprise wire mesh, expanded metal, or a thermoset polymer. The metal inner shell would be attached to either the polymeric housing or attached to the inlet and outlet exhaust pipes. If the metal shell has perforations, an inflatable tube would be placed within the polymeric housing and inflated so that the tube expands into the perforation openings of the metal inner layer. A cast-in-place foam thermal insulation would then be injected between the metal inner shell and the polymeric housing. The inflatable tube can then be deflated and removed and the cast-in-place foam cured to provide muffler assembly 7.

Another embodiment is a process for making a polymeric muffler assembly having a polymeric housing comprising the steps of:

a) assembling a combination of metal inlet and outlet exhaust pipes connected together with metal baffles or metal support braces to form a pipe sub-assembly;

b) enclosing the pipe sub-assembly using complementary polymeric housing sections having interior surfaces to provide a polymeric housing having housing-exhaust pipe interfaces; said interior surfaces comprising an inner layer or coating of thermal insulating material extending through the housing exhaust pipe interfaces;

c) adhering or attaching the polymeric housing sections together to form said polymeric muffler assembly;

wherein the thermal insulating material seals the muffler assembly at the housing-exhaust pipe interfaces.

Another embodiment is a process for making a polymeric muffler assembly comprising the steps of:

a) assembling a combination of metal inlet and outlet exhaust pipes connected together with metal support brackets or metal baffles to form a pipe sub-assembly;

b) enclosing the pipe sub-assembly with a layer or coating of thermal insulating material to form an enclosed pipe sub-assembly;

c) placing or sliding the enclosed pipe sub-assembly into a pre-extruded or molded polymeric housing having openings for inlet and outlet exhaust pipes;

d) attaching body counting adapters to the metal inlet and outlet exhaust pipes positioned within said openings to provide polymeric housing-body mounting adapter interfaces;

wherein the thermal insulating material extends through the polymeric housing-body mounting adapter interfaces to seal the polymeric muffler assembly and;

wherein the body mounting adapters form the end plates of the muffler assembly.

Another embodiment is a process for making a polymeric muffler assembly comprising the steps of:

a) assembling a combination of metal inlet and outlet exhaust pipes connected together using metal support braces or metal baffles to form a pipe sub-assembly wherein at least one section of pipe is perforated;

b) inserting into the perforated pipe of the pipe sub-assembly an inflatable tube;

c) enclosing the pipe sub-assembly from step (b) with polymeric housing sections comprising an inner layer or coating of cast in place thermal insulating material to form a polymeric muffler sub-assembly;

d) adhering or attaching the polymeric housing sections of the polymeric muffler sub-assembly together;

e) inflating the inflatable tube so that the tube expands into the perforations;

f) curing the cast in place thermal insulating material;

g) deflating and removing the inflatable tube to form a polymeric muffler assembly;

wherein the cured cast in place thermal insulating material forms a seal between the polymeric housing and the inlet and outlet exhaust pipes of the polymeric muffler assembly.

Another embodiment is a process for making a polymeric muffler assembly comprising the steps of:

a) assembling a combination of metal inlet and outlet exhaust pipes connected together using metal support braces or metal baffles to form a pipe sub-assembly;

b) attaching to the pipe sub-assembly a solid metal housing which surrounds the pipe sub-assembly;

c) enclosing the pipe sub-assembly from step (b) with polymeric housing sections to form a polymeric muffler sub-assembly having a void space between the inner surface of the polymeric housing and the solid metal housing;

d) adhering or attaching the polymeric housing sections together;

e) injecting a cure in place foam material into the void space of the polymeric muffler sub-assembly;

f) curing the cure in place foam material;

wherein the cured cast in place thermal insulating material forms a seal at the interface of the polymeric housing and the inlet and outlet exhaust pipes of the polymeric muffler assembly.

In the processes disclosed above, in various embodiments the pipe sub-assembly further comprises at least one perforated pipe attached to the metal inlet and outlet exhaust pipes with metallic baffles or metallic braces. in various embodiments the thermal insulating material comprises a material selected from an aerogel material, a foamed insulating material, a fiber, a fabric, or a mat. In various embodiments the polymeric housing sections are attached by fasteners, high temperature adhesives; or a polymeric welding process. In various embodiments the polymeric housing sections are attached using a polymeric welding process selected from ultrasonic welding, laser welding, or vibrational welding.

Example of Muffler Assembly

The muffler design fabricated is that of FIG. 3 wherein the thermal insulation layer is a geopolymer made from a foam insulation matrix embedded with glass spheres into the foamed geopolymer, as described in the materials section for geopolymers.

Two polymeric housing half shells (32.8 cm×30.3 cm×7.6 cm deep) are prepared by injection molding of DuPont Zytel® HTN 54G35HSLR BK031 resin (melting point about 300° C.). The housing shells have nominal 89 mm diameter semicircle depressions on the sides of both ends to receive circular body mounting adapters; and male and female linear vibration weld joints at the interface of the polymeric housing half shells. Each shell also includes an aperture approximately 12 mm in diameter located in the center of the shell.

A sub-assembly consisting of stainless steel exhaust pipes having a plurality of perforations, and two circular stainless steel body mounting adapters having a mounting flange (nominal 89 mm outer diameter) and a outward protruding inner flange (18.3 mm wide) having a 63.5 mm inner diameter for receiving the exhaust pipes, and a solid metal inner shell made to enclose the perforated section of the pipe was then prepared for installation into the polymeric housing shells. The solid metal shell is spot-welded to the exhaust pipe such that it encloses the perforated area of the exhaust pipe. The body mounting adapters are then welded onto the pipe in the proper positions such that the mounting adapters, when lined up with the polymeric housing shells, provide a housing-body mounting adapter interface located in the semi-circular openings molded into each end of the housing halves.

The lined polymeric casings are vibrationally welded together around the pipe assembly using a Branson VW-8 Ultra Hy-Line vibration welder with tooling built specifically for the shape of the polymeric casings. The lower shell half is placed in the lower (stationary) half of the tooling, and the upper half is placed in the upper (vibrating) half of the tooling. The pipe assembly is then placed in the openings of the lower casing. The pieces are welded together using the following parameters:

Weld Amplitude: 0.070"
Weld Force: 2500 lbs
Hold Force: 2500 lbs
Melt Distance: 0.085"
Hold Time: 10 Seconds.

After the pipe sub-assembly is welded together, a wet geopolymer foam/glass sphere slurry is injected into the space created by the polymeric housing and solid inner shell such that it filled the internal cavity formed between the inside surface of the welded polymeric half shells and the outer surface of the solid metal inner shell. The slurry is injected into the lower aperture of the assembly and excess allowed to discharge from the upper aperture. In another instance, the slurry can be pressurized such that any gaps or imperfections in the interfaces between mating pieces of the assembly were filled in order to provide a desired seal. Once the injected insulating material has cured, the excess material on the outer surface of the muffler assembly is removed to provide a muffler assembly.

Leak Test Procedure

The following leak test procedure was used to evaluate the sealing properties of the thermal insulation material of the muffler assemblies of the invention.

The muffler design tested comprised body mounting adapters (with lips) wherein the thermal insulation layer acted as both a thermal insulation layer and a sealing layer as shown in FIG. 2B.

To prepare the muffler for testing, the outlet exhaust pipe is completely plugged or sealed with an expanding pipe plug (available from Oatey Plumbing) of a size that will completely seal the pipe of the muffler being tested. If there is a drain hole in the muffler casing, the drain hole is also to be sealed off with a rubber stopper or equivalent sealing device.

A modified expanding pipe plug is used on the other remaining inlet/outlet pipe. The plug is modified such that a hose can be attached in a manner that allows the perimeter of the plug to seal off the pipe, while still providing a means to allow air pressure into the muffler casing through the center of the plug.

A leak testing device was constructed for testing the assembled muffler units consisting of an adjustable air pressure regulator, a digital pressure readout display (reading from a pressure transducer), and a flow meter also utilizing a digital readout. The pressure regulator is connected to a supply of compressed atmospheric air, and plumbed to the pressure transducer. Downstream of the pressure transducer is a flow meter connected such that it measures the flow of air into the test subject. The testing device (regulator, pressure transducer and flow meter assembly) is connected to the muffler assembly via a length of hose which attaches to the aforementioned modified expanding pipe plug.

After the muffler assembly is connected to the testing device as described above, the following testing procedure was followed.

The air supply is turned on and the air pressure is manually adjusted via the regulator until the pressure in the muffler stabilizes at the desired pressure reading (1 psig and 4.5 psig for this test) according to the digital pressure readout. Once the desired pressure is reached and the pressure stabilized, the air flow rate is read from the flow meter digital readout. This value is the leak rate of the muffler assembly and is measured in Liters/minute. The air supply is then shut off and the muffler is disconnected from the testing device.

A muffler assembly of the invention passes the leak rate test if the leak rate is less than 105 liters/min.

The invention claimed is:

1. A reflective muffler assembly comprising:

a) a polymeric housing having an interior surface and at least one opening for at least one inlet and one outlet exhaust pipe;

b) at least one metal inlet exhaust pipe and at least one metal outlet exhaust pipe positioned within said openings to provide housing-exhaust pipe interfaces;

c) a thermal insulating material coating said interior surface of the polymeric housing and extending through the housing-exhaust pipe interfaces; and d) a metal inner shell or a perforated metal inner shell conforming to the shape of the thermal insulating material;

wherein said thermal insulating material seals the muffler assembly at the housing-exhaust pipe interfaces; and wherein the muffler assembly has a leak rate of 105 Liters/minute or less at 4.5 psig pressure.

2. The muffler assembly of claim 1 wherein the polymeric housing further comprises internal polymeric baffles and said thermal insulating material coating said interior surface of the polymeric housing also coats said polymer baffles.

3. The muffler assembly of claim 1 further comprising internal metallic baffles or metallic braces attached to both the inlet and outlet exhaust pipes.

4. The muffler assembly of claim 1 further comprising at least one perforated metal pipe inside the polymeric housing, and wherein the at least one additional perforated metal pipe is attached to the metal inlet and outlet exhaust pipes with metallic baffles or metallic braces.

5. The muffler assembly of claim 1 in which one or both metal exhaust pipes are perforated in the interior of the polymeric housing.

6. The muffler assembly of claim 1 wherein the thermal insulating material is folded over at the polymeric housing-exhaust pipe interface such that the thickness of the thermal insulating material at the interface is greater than the thickness of the thermal insulating material not at the interface.

7. The muffler assembly of claim 1 wherein the polymeric housing comprises a polymer selected from semi-crystalline polyamides, thermotropic liquid crystalline polymers, polyesters, polyacetals, epoxy resins, melamine resins, phenolic resins, polyimides, and poly(p-phenylenes).

8. A reflective muffler assembly comprising:

a) a polymeric housing having an interior surface and at least one opening for at least one inlet and one outlet exhaust pipe;

b) at least one metal inlet exhaust pipe and at least one metal outlet exhaust pipe having body mounting adapters attached to the inlet and outlet exhaust pipes and positioned within said openings within said openings to provide housing-body mounting adapter interfaces;

c) a thermal insulating material coating the interior surface of the polymeric housing and extending through the housing-body mounting interfaces; and d) a metal inner shell or a perforated metal inner shell conforming to the shape of the thermal insulating material;

wherein said thermal insulating material seals the muffler assembly at the housing-body mounting adapter interfaces; and wherein the muffler assembly has a leak rate of 105 Liters/minute or less at 4.5 psig pressure.

9. The muffler assembly of claim 8 wherein the thermal insulating material is folded over at the polymeric housing-body mounting adapter interface such that the thickness of the thermal insulating material at the interface is greater than the thickness of the thermal insulating material not at the interface.

10. The muffler assembly of claim 8 wherein the polymeric housing further comprises internal polymeric baffles and said thermal insulating material coating said interior surface of the polymeric housing also coats said polymer baffles.

11. A process for making a polymeric muffler assembly having a polymeric housing and inlet and outlet exhaust pipes comprising the steps of:

a) assembling a combination of metal inlet and outlet exhaust pipes connected together with metal baffles or metal support braces to form a pipe sub-assembly;

b) enclosing the pipe sub-assembly using complementary polymeric housing sections having interior surfaces to provide a polymeric housing having housing-exhaust pipe interfaces; said interior surfaces comprising an inner layer or coating of thermal insulating material extending through the housing exhaust pipe interfaces and a metal inner shell or a perforated metal inner shell encompassing and conforming to the shape of the thermal insulating material;

c) adhering or attaching the polymeric housing sections together to form said polymeric muffler assembly;

wherein the thermal insulating material seals the muffler assembly at the housing-exhaust pipe interfaces.

12. The process of claim 11 wherein the pipe sub-assembly further comprises at least one perforated pipe attached to the metal inlet and outlet exhaust pipes with metallic baffles or metallic braces.

13. The process of claim 11 wherein the thermal insulating material comprises a material selected from an aerogel material, a foamed insulating material, a fiber, a fabric, or a mat.

14. The process of claim 11 wherein the polymeric housing sections are attached in step (c) by fasteners, high temperature adhesives, or a polymeric welding process.

15. The polymeric welding process of claim 14 selected from ultrasonic welding, laser welding, or vibrational welding.

16. A process for making a polymeric muffler assembly comprising the steps of:

a) assembling a combination of metal inlet and outlet exhaust pipes connected together with metal support brackets or metal baffles to form a pipe sub-assembly;

b) enclosing the pipe sub-assembly with a layer or coating of thermal insulating material to form an enclosed pipe sub-assembly;

c) placing or sliding the enclosed pipe sub-assembly into a pre-extruded or molded polymeric housing having openings for inlet and outlet exhaust pipes;

d) attaching body mounting adapters to the metal inlet and outlet exhaust pipes positioned within said openings to provide polymeric housing-body mounting adapter interfaces wherein the thermal insulating material extends through the polymeric housing-body mounting adapter interfaces to seal the polymeric muffler assembly and;

wherein the body mounting adapters form the end plates of the muffler assembly.

17. The process of claim 16 comprising an additional step (b1) after step (b) and before step (c) wherein the coated pipe sub-assembly is enclosed by a metal layer.

18. A process for making a polymeric muffler assembly comprising the steps of:

a) assembling a combination of metal inlet and outlet exhaust pipes connected together using metal support braces or metal baffles to form a pipe sub-assembly wherein at least one section of pipe is perforated;

b) inserting into the perforated pipe of the pipe sub-assembly an inflatable tube;

c) enclosing the pipe sub-assembly from step (b) with polymeric housing sections comprising an inner layer or coating of cast in place thermal insulating material to form a polymeric muffler sub-assembly;

d) adhering or attaching the polymeric housing sections of the polymeric muffler sub-assembly together;

e) inflating the inflatable tube so that the tube expands into the perforations;

f) curing the cast in place thermal insulating material;

g) deflating and removing the inflatable tube to form a polymeric muffler assembly;

wherein the cured cast in place thermal insulating material forms a seal between the polymeric housing and the inlet and outlet exhaust pipes of the polymeric muffler assembly.

19. A process for making a polymeric muffler assembly comprising the steps of:

a) assembling a combination of metal inlet and outlet exhaust pipes connected together using metal support braces or metal baffles to form a pipe sub-assembly;

b) attaching to the pipe sub-assembly a solid metal housing which surrounds the pipe sub-assembly;

c) enclosing the pipe sub-assembly from step (b) with polymeric housing sections to form a polymeric muffler sub-assembly having a void space between the inner surface of the polymeric housing and the solid metal housing;

d) adhering or attaching the polymeric housing sections together;

e) injecting a cure in place foam material into the void space of the polymeric muffler sub-assembly;

f) curing the cure in place foam material;

wherein the cured cast in place thermal insulating material forms a seal at the interface of the polymeric housing and the inlet and outlet exhaust pipes of the polymeric muffler assembly.

* * * * *